US006905133B2

(12) United States Patent
Lett

(10) Patent No.: US 6,905,133 B2
(45) Date of Patent: Jun. 14, 2005

(54) SWIVEL MOUNT FOR BOARD BINDINGS

(75) Inventor: Ralph Lett, Vernon (CA)

(73) Assignee: 597990 B.C. Ltd., Vernon (CA)

( * ) Notice: Subject to any disclaimer, the term of this patent is extended or adjusted under 35 U.S.C. 154(b) by 95 days.

(21) Appl. No.: 10/221,623

(22) PCT Filed: Mar. 13, 2001

(86) PCT No.: PCT/CA01/00331

§ 371 (c)(1),
(2), (4) Date: Sep. 13, 2002

(87) PCT Pub. No.: WO01/68199

PCT Pub. Date: Sep. 20, 2001

(65) Prior Publication Data

US 2003/0038455 A1 Feb. 27, 2003

(51) Int. Cl.[7] ..... A63C 9/081
(52) U.S. Cl. ..... 280/618; 280/14.22
(58) Field of Search ..... 280/607, 617, 280/618, 14.21, 14.22

(56) References Cited

U.S. PATENT DOCUMENTS 4,728,116 A * 3/1988 Hill ..... 280/618
4,964,649 A 10/1990 Chamberlin
5,028,068 A * 7/1991 Donovan ..... 280/618
5,499,837 A 3/1996 Hale et al.
5,782,476 A * 7/1998 Fardie ..... 280/14.24
5,791,678 A 8/1998 Perlman
5,820,139 A 10/1998 Grindl
5,941,552 A 8/1999 Beran
5,947,488 A * 9/1999 Gorza et al. ..... 280/14.21
6,022,041 A * 2/2000 Dailey et al. ..... 280/618
6,102,430 A 8/2000 Reynolds
6,155,591 A * 12/2000 Huffman et al. ..... 280/618
6,290,243 B1 9/2001 Beran
6,499,760 B1 * 12/2002 Tindall et al. ..... 280/618

FOREIGN PATENT DOCUMENTS

WO PCT/US99/09198 4/1998

* cited by examiner

*Primary Examiner*—Bryan Fischmann
(74) *Attorney, Agent, or Firm*—Antony C. Edwards

(57) ABSTRACT

A swivel mount for a board binding includes a base mountable to an upper surface of a board, and a swivel plate rotatably mounted on the base for relative swivelling rotation of the swivel plate relative to the base between a ride position and forward-walking positions. A rotational resistance device cooperates between the swivel plate and the base for increasing rotational resistance above that of free-floating rotation but without locking of the swivel plate in a preset locking position when swivelling the swivel plate through the radial arc of the forward-walking positions. A ride position latch releasable locks the swivel plate in the ride position. An actuator releases the ride position latch. The applied force urges the swivel plate to swivel from said ride position to the forward-walking position.

42 Claims, 20 Drawing Sheets

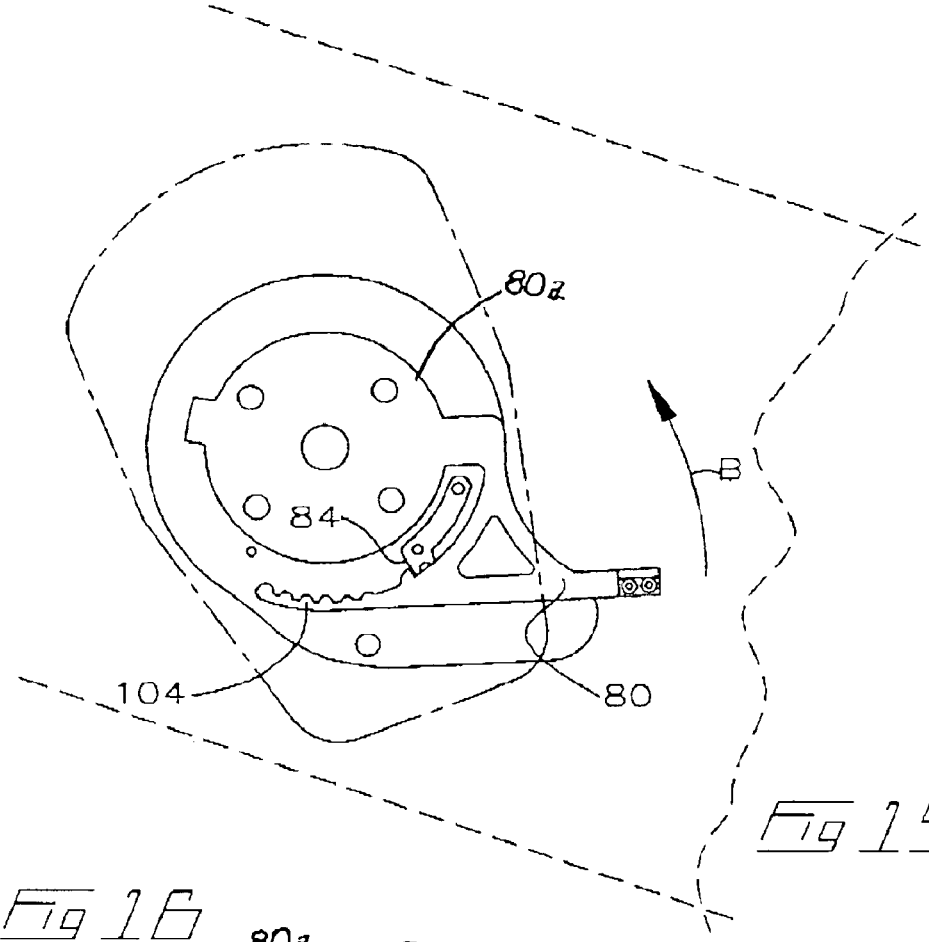
Fig 15
Fig 16
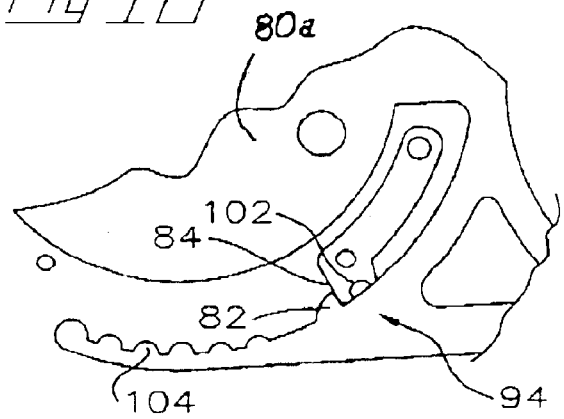

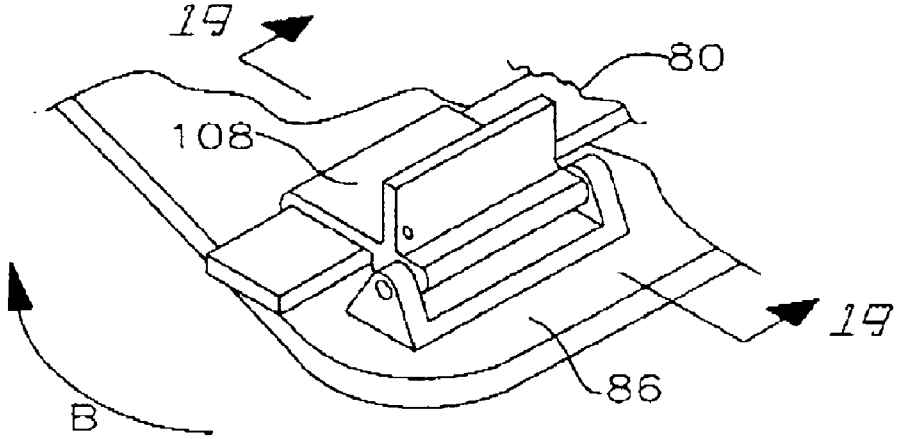
Fig 18
Fig 19
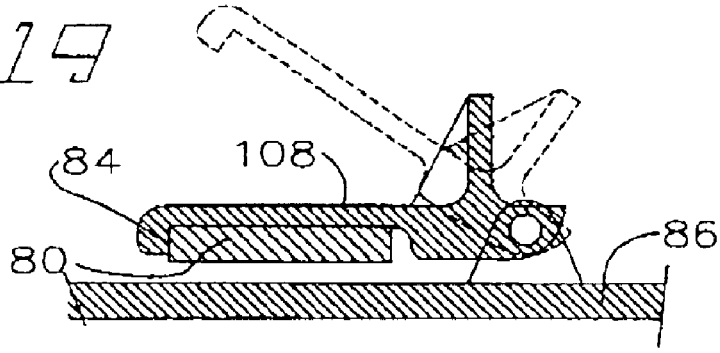

Fig 37
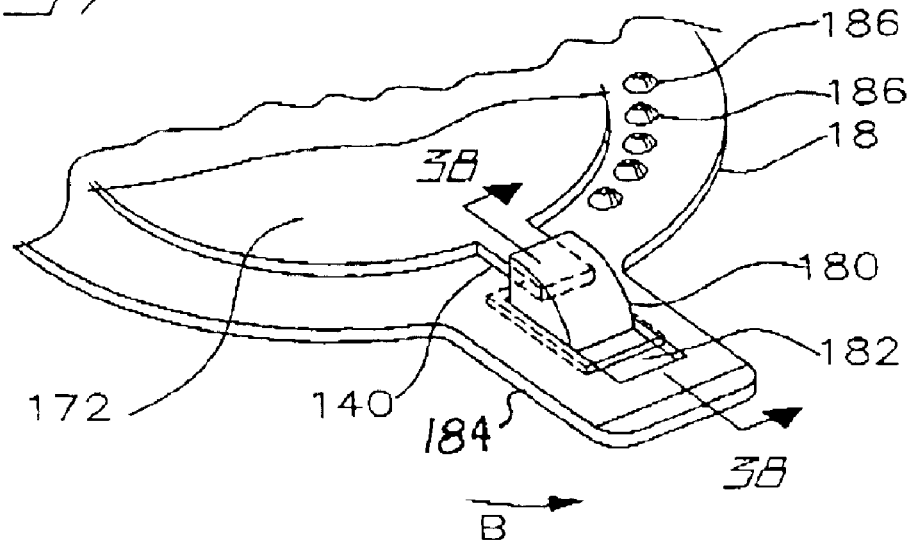
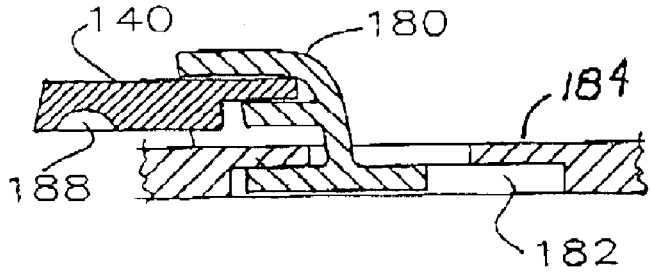
Fig 38

Fig 41
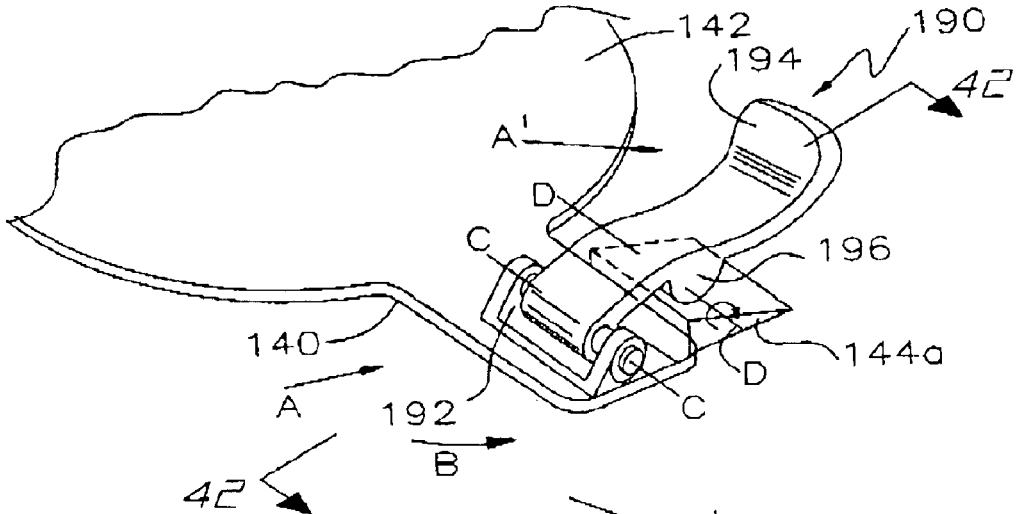
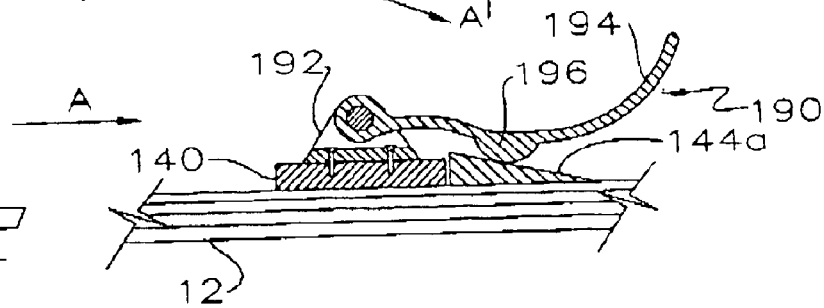
Fig 42
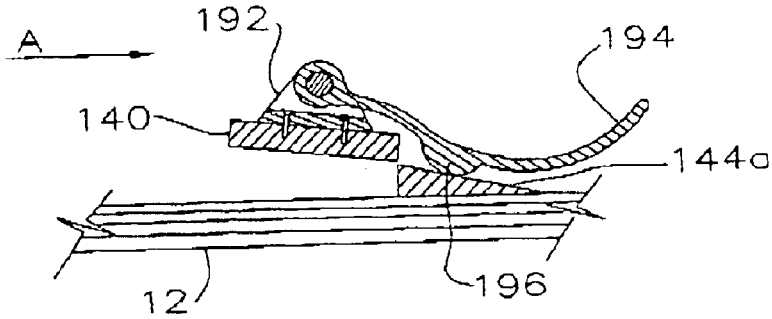
Fig 43

SWIVEL MOUNT FOR BOARD BINDINGS

FIELD OF THE INVENTION

This invention relates to a swivel connector for securing foot bindings to a snowboard, an in-line wheel-mounted land board or the like. More particularly, it relates to a swivel connector that will permit the binding for the forward foot to be swivelled from a normal ride position which is angularly disposed relative to the longitudinal centerline of the snowboard to a position which is substantially aligned with the longitudinal centerline of the snowboard.

BACKGROUND OF THE INVENTION

During the normal use of a riding board such as a snowboard or an in-line wheel-mounted land board, the user places his or her feet in fore and aft bindings which are immovably secured to the board. The bindings are disposed at an angle to the longitudinal centerline of the board so that of necessity the user must adopt a side-forward stance. For propulsion on relatively flat terrain, for example in, the vicinity of a chairlift loading area, the normal procedure is to disengage the rear foot from its binding and to use this foot to propel the board. Since the forward binding holds the users foot and ankle at an angle to the direction of travel, the user must compensate by twisting the forward knee and the upper body into a face forward stance in order to maintain a constant direction of travel. Further, while riding on the chairlift, the board is positioned at an awkward and tiring angle from the users forward foot.

In the prior art, applicant is aware of U.S. Pat. No. 6,102,430 which issued to Reynolds on May 7, 1998, for a Dual-Locking Automatic Positioning Interface for a Snowboard Binding. Reynolds teaches a boot binding frame 20 clamped between a retainer slip disk 26 positioned on an upper surface of a boot binding frame 20 and a swivel ring 28 positioned on a lower surface. The boot binding frame 20 is fixedly secured to swivel ring 28 for rotational movement therewith, while slip disk 26 is non-rotatively mounted to the snowboard 12. Thus swivel ring 28 and the boot binding frame 20 may be rotated relative to both snowboard 12 and slip disk 26. Rotation between the respective pieces is permitted by a disk receptacle or aperture 34 formed in boot binding frame 20. Since the boot binding frame requires a disk receptacle 34 of a substantial diameter, retrofitting of the Reynolds device to existing snowboard boot binding frames would have limited application and the most practicable application would be the purchase of new boot binding frames specifically designed to cooperate with his device. In the present invention the device is adapted for retrofit to existing binding frames as the components are located beneath the boot binding frame eliminating the need for an equivalent to the disk receptacle 34 of Reynolds, without precluding incorporation of the present invention with new binding frames.

Further, the locking mechanism 42 of Reynolds is detached from either slip disk 26 or swivel ring 28 and is separately mounted to snowboard 12. Within locking mechanism 42 a spring urges locking detent coupler lever 44 into engagement with swivel ring 28. To release lever 44 from engagement with the locking detents in swivel ring 28, lever 44 is rotated in a direction which is rotationally opposite to the direction of rotation of the boot binding frame 20 when the frame is rotated toward the walking forward orientation, that is, the so-called Reynolds' soft lock position. Thus, unlike in the present invention, the user kicking the lever to release the ride position lock does not thereby both unlock the swivel and apply angular momentum to the swivelling of the user's forward foot into the forward-walking position.

Further, unlike the present invention, operation of the locking mechanism 42 of Reynolds does not assist the user with repositioning of boot binding frame 20 according to the terrain or task at hand such as dismounting a lift or against increased resistance caused by snow and ice which may tend to clog the swivel mechanism during use. Further, Reynolds has locking positions, including the forward soft lock, which does not provide for the bi-directional range of rotational resistance of the forward-walking positions of the present invention.

It is, therefore, an object of this invention to provide a means for overcoming the difficulties encountered while trying to propel a board on relatively level terrain or in the vicinity of the chairlift boarding and dismount area or for use on a T-bar lift during boarding, dismount and transition.

A further object of this invention is to provide a swivel connector for securing the forward binding of a board so that the user may easily reposition his forward foot from a ride position to forward-walking positions.

SUMMARY OF THE INVENTION

The swivel mount for a board binding of the present invention includes a base mountable to an upper surface of a board, and a swivel plate rotatably mounted on the base for relative swivelling rotation of the swivel plate relative to the base between a ride position and forward-walking positions. The swivel plate may be a separate component from the binding or integrally mounted into, or formed as part of the binding.

When the swivel plate is in the ride position the binding is oriented generally perpendicularly to a longitudinal axis of the board. When the swivel plate is in the forward-walking positions, the binding is oriented to point a user's first foot, for example the forward foot, in the binding toward a front end of the board so as to generally form an acute angle between the binding and the longitudinal axis of the board. The forward-walking positions extend in a radial arc radially spaced from the ride position.

A non-locking, non free-floating rotational resistance means cooperates between the swivel plate and the base for increasing rotational resistance above that of free-floating rotation but without locking of the swivel plate in a preset locking position when swivelling the swivel plate through the radial arc. The rotational resistance means provides resistance of a level between free-floating rotation having substantially no resistance to rotation, and locking rotational resistance requiring unlocking by a user's hand or second foot, for example the rearward foot, to permit rotation.

At least one ride position latch is provided for releasably locking the swivel plate in the ride position relative to the base upon rotational urging by the user's first foot when the first foot is in the binding or integral with the swivel plate so as to return the swivel plate from the forward walking position to the ride position.

An actuator is provided for releasing the ride position latch. The actuator is actuated by a force applied by the second foot in a first direction urging the swivel plate to swivel from said ride position to the forward-walking positions.

The actuator may comprise a flexible arm flexibly mounted to the swivel plate. The flexible arm may have a force receiving member at a first distal end thereof, the first distal end extending generally radially outwardly of the swivel plate. The ride position latch may comprise a first pawl mounted on the flexible arm and a detent member fixedly mounted relative to the upper surface of the board, for example mounted to the board or to the base. The detent member forms a detent. The first pawl is for releasably engaging the detent so as to releasably lock the swivel plate in the ride position. The flexible arm is actuable by a force applied generally in the first direction so as to flex relative to the swivel plate to thereby release the pawl from the engagement with the detent.

Alternatively, the ride position latch may comprise only a detent member fixedly mounted relative to the upper surface of the board, the detent member forming a detent, and the flexible arm releasably engaging the detent so as to releasably lock the swivel plate in the ride position. The force receiving member, upon receiving a force applied thereto in the direction of rotation of the swivel plate from the ride position to the forward-walking positions, flexes the flexible arm so as to disengage the flexible arm from the detent. Where the flexible arm flexes in the plane of the swivel plate, the force receiving member may be a rigid kick plate.

The force receiving member may be a lever for disengaging the flexible arm from the detent by flexing the flexible arm out of a plane containing the swivel plate. Such a force receiving member may be a rocker arm having a fulcrum engaging an upper surface of the detent member forming the detent.

The resistance means may comprise a second pawl and an array of pawl receivers lying in a rotational trajectory of the second pawl for mating with the second pawl.

The second pawl may be mounted on the swivel plate, and the array of pawl receivers may be formed in the base. Alternatively, the second pawl may be mounted on the base and the array of pawl receivers may be formed in the swivel plate. Further alternatively, the second pawl may be mounted on the actuator and the array of pawl receivers may be formed on the base. Alternatively, the second pawl may be mounted on the base and the array of pawl receivers may be formed on the actuator.

BRIEF DESCRIPTION OF THE DRAWINGS

FIG. 15 is a plan view of an alternative embodiment of the present invention.

FIG. 16 is an enlarged view of the rotation arresting device of FIG. 15.

FIG. 18 is an isometric view illustrating an alternative means for securing the swivel plate lever in the ride position.

FIG. 19 is a sectional view taken on line 19—19 of FIG. 18.

FIG. 37 is, in partially cut-away perspective view, a further embodiment of the ride position latch of the swivel mount of the present invention.

FIG. 38 is a partially cut-away cross-sectional view along line 38—38 in FIG. 37.

FIG. 41 is, in enlarged partially cut-away perspective view, an alternative embodiment of a ride position latch release.

FIG. 42 is a sectional view along line 42—42 in FIG. 41.

FIG. 43 is the latch release of FIG. 42 releasing the latch.

DETAILED DESCRIPTION OF EMBODIMENTS OF THE INVENTION

As used herein, reference to snowboard or board is meant to include all forms of riding boards whether for use on snow, or on soft or hard terrain, flat or rough, whether the board slides on its under-surface or rolls on wheels, tracks or other conveyor means. Further, as used herein, reference to a user's forward foot or rearward foot or reference to a forward binding or rearward binding are intended to be interchangeable. That is, although described in relation to the normal situation where a user removes the rear foot from the rear binding during use of an uphill lift or during flat terrain translation, the scope of the present invention is intended also to cover the reverse, where a user instead removes a forward foot from the forward binding.

Figure 1:
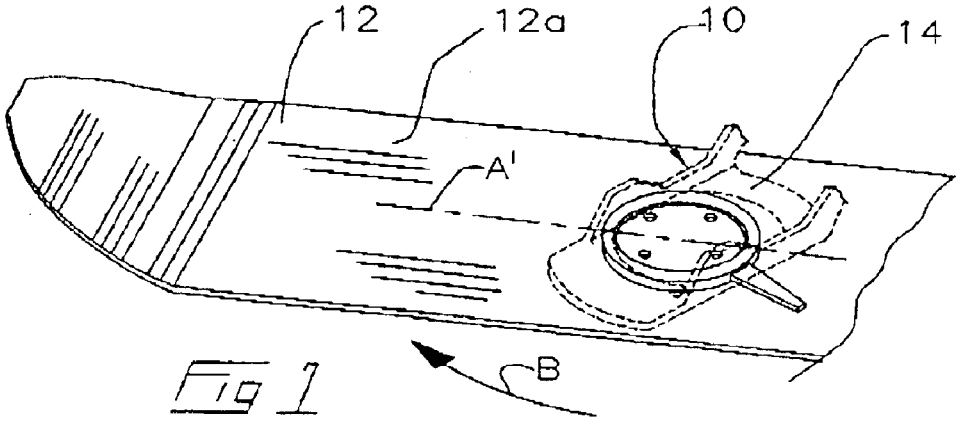
FIG. 1 is a perspective view of the swivel mount of the present invention mounted on a snowboard in a normal ride position.
Figure 2:
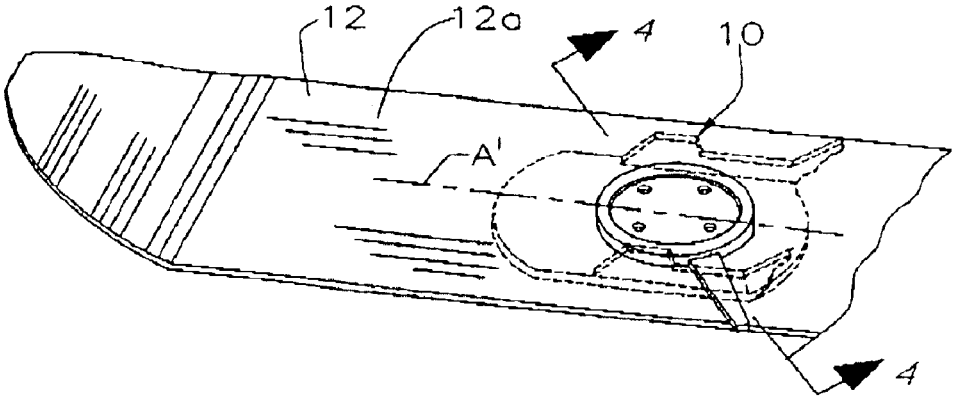
FIG. 2 is a perspective view of the swivel mount of FIG. 1 in a rotated forward-walking position, substantially aligned with the longitudinal axis of the snowboard.

As seen in FIGS. 1 and 2, swivel mount 10 is mounted to upper surface 12*a* of a board 12 at the location where the forward binding 14 is to be mounted. Mount 10 has a relatively low side-on profile so as to be raised only minimally above upper surface 12*a*. A user may choose to secure a disk shaped spacer (not shown) of similar thickness beneath the rear binding to provide a level stance.

Figure 3:
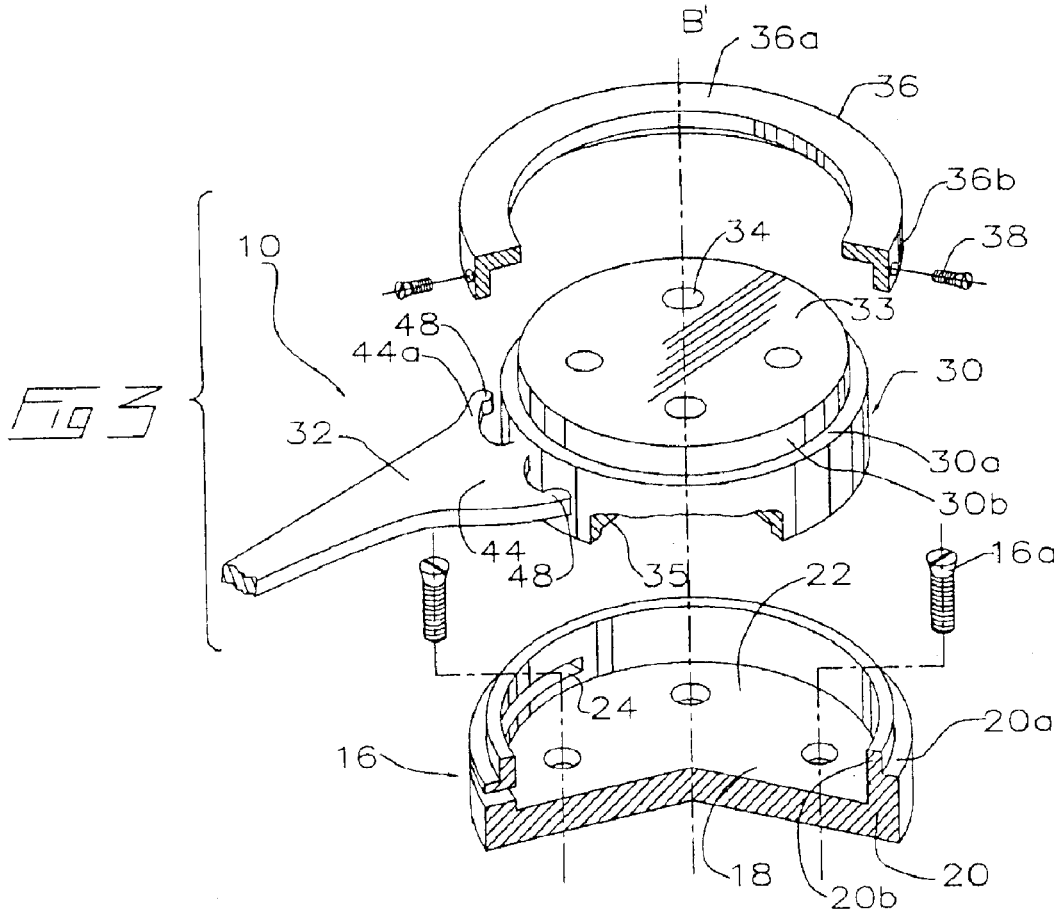
FIG. 3 is an exploded perspective view of one embodiment of the swivel mount of the present invention.
Figure 4:
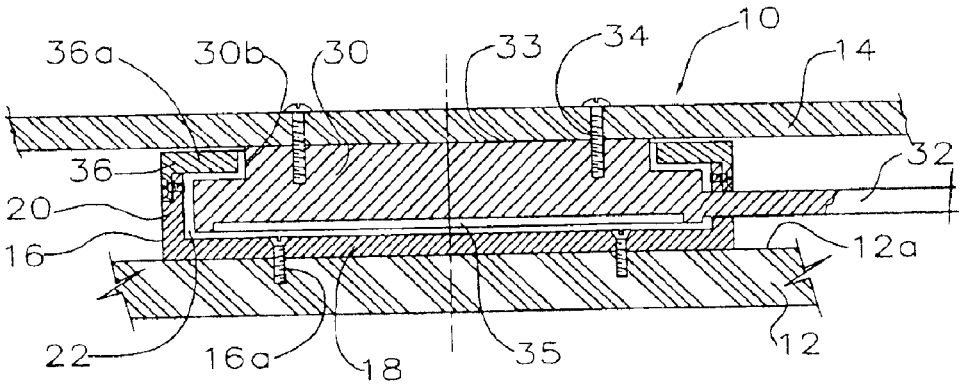
FIG. 4 is a sectional view taken on line 4—4 of FIG. 2.

As seen in FIGS. 3 and 4, connector 10 includes in one embodiment a swivel housing 16 which may be mounted to snowboard 12 by screws 16*a*. Swivel housing 16 has a base 18 and an upstanding annular perimeter wall 20 which define a cavity 22 therebetween. Perimeter wall 20 is formed with annular shoulder 20*a* on its exterior surface. This results in a slightly recessed upstanding annular collar portion 20*b*. Slot 24 in wall 20 is positioned between base 18 and shoulder 20*a*, parallel to the base.

A swivel plate 30 is rotatably mounted within cavity 22 of housing 16. A locking lever 32 projects laterally outward from plate 30. Locking lever 32, which in all embodiments of locking levers or arms herein may be manufactured from a resilient material such as spring steel or robust plastic, extends outward through slot 24 formed in perimeter wall 20. Swivel plate 30 is formed with an inwardly turned annular shoulder 30*a* on the exterior surface, which results in an annular outer surface 30*b* defining an upper planar surface 33. The upper edge of wall 20 extends slightly above annular shoulder 30*a* on swivel plate 30. Upper planar face 33 has a plurality of threaded holes 34 enabling binding 14 to be rigidly bolted thereto. A recess 35 may be formed on the underside of swivel plate 30 to reduce surface area contact with base 18.

A locking ring 36 having an annular upper surface 36*a* and a contiguous annular depending sidewall 36*b* is mounted over swivel housing 16. Depending sidewall 36*b* slides over recessed upstanding annular collar portion 20*b* formed on perimeter wall 20 of swivel housing 16 until sidewall 36*b* contacts annular shoulder 20*a* and the upper face 33 of cylindrical swivel plate 30 projects slightly outwardly of upper surface 36*a* of locking ring 36. Locking ring 36 is secured to housing 16 with setscrews 38. Annular upper surface 36*a* extends radially inwardly so as to be in proximity to annular outer surface 30*b* of swivel plate 30 to inhibit snow and moisture incursion.

Figure 5:
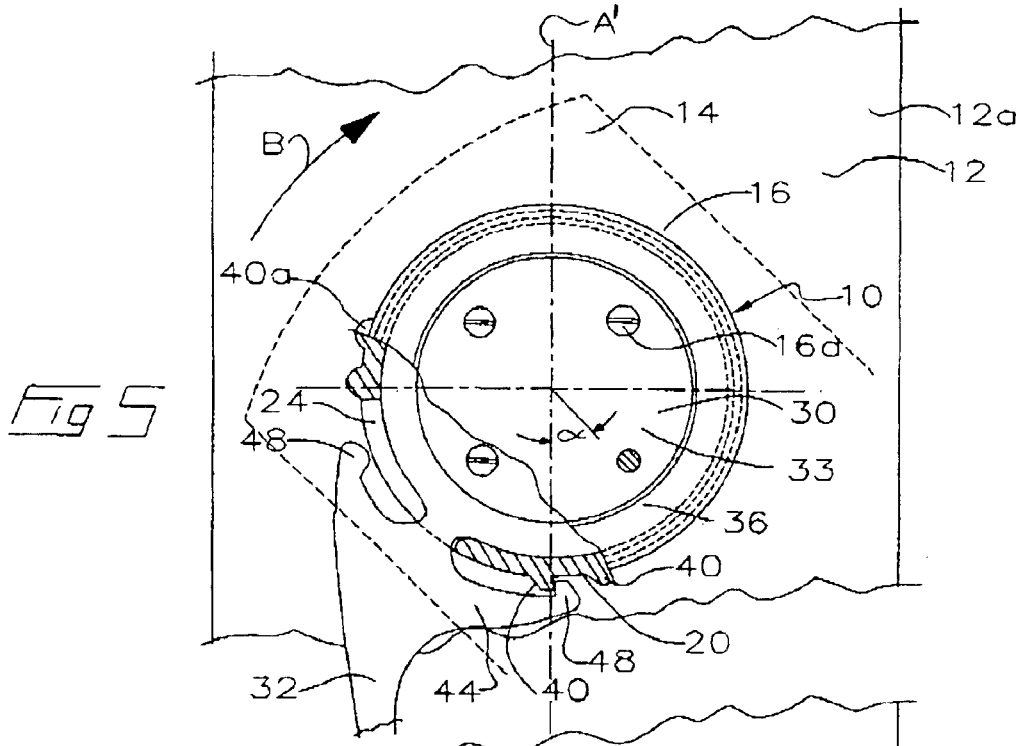
FIG. 5 is a plan view, partially in section, illustrating the swivel mount of FIG. 1.
Figure 6:
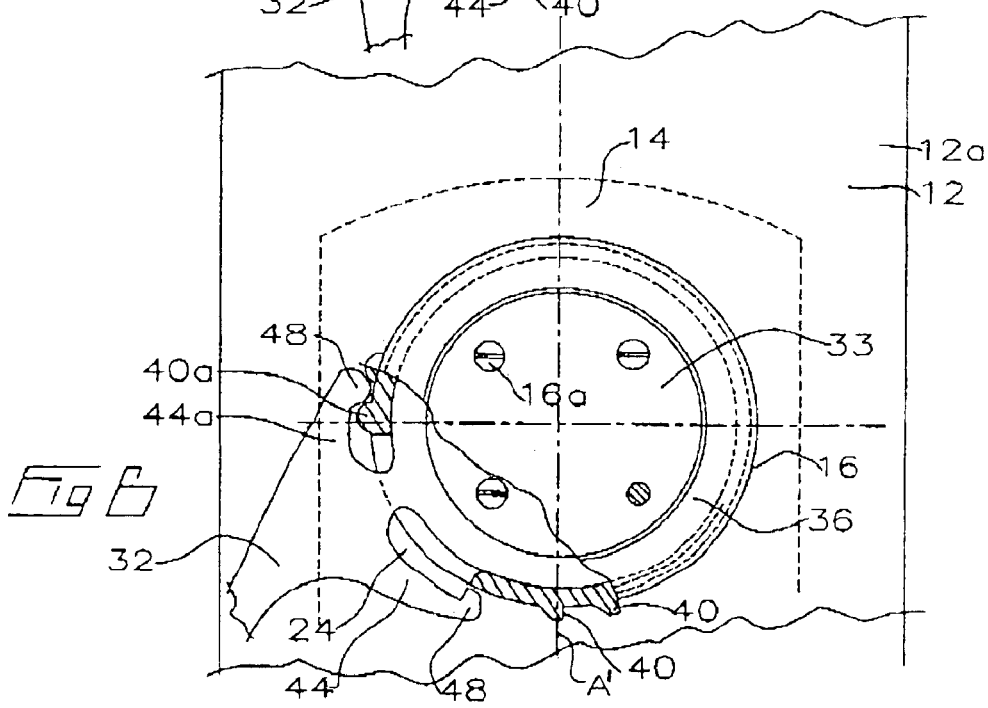
FIG. 6 is a plan view, partially in section, of the swivel mount of FIG. 2.

As seen in FIGS. 5 and 6, perimeter wall 20 has at least one primary detent 40 at a first end of slot 24 and a plurality of secondary detents or protrusions 40*a* formed at the opposite second end of slot 24. Although only two primary detents 40 are illustrated, this is not intended to be limiting as it may be desirable to have more than merely one or two latching ride positions. Thus in all of the embodiments herein, it is expressly intended to be within the scope of the invention to include a plurality of ride position latches, radially spaced from one another, to allow for a user to select a desirable or comfortable ride position.

Locking lever 32 has oppositely disposed arcuately curved arms 44 and 44*a* which extend laterally outward of the lever, adjacent to wall 20. A pawl 48 projects from the distal end of each of the arms for firmly engaging detents 40 and 40*a*. Pawl 48 on arm 44 engages primary detent 40. Pawl 48 on arm 44*a* engages secondary detents 40*a*. Because binding 14 is mounted to swivel plate 30, rotating lever 32 so as to engage pawls 48 with either detents 40 or 40*a* also correspondingly rotates binding 14. Thus the binding may be rotated by a user so as to latch into a ride position when pawl 48 on arm 44 is mated behind primary detent 40. Reference to the ride position herein connotes the normal angular orientation of bindings 14 for riding on the board, that is, substantially or generally perpendicular to longitudinal axis A'.

FIG. 5 illustrates binding 14 (in dotted outline) positioned at an angle $\propto$ relative to the longitudinal axis A' of the snowboard 12. Pawl 48 on arm 44 is latched behind detent 40. Again, this angular orientation of binding 14 relative to board 12 is intended to indicate the normal "ride" position of a user's foot when the user is riding on the board with the user's foot mounted to the board by the binding. Unintended rotation in direction B of binding 14 out of the ride position, so as to point the foot of the user toward the front of the board along longitudinal axis A' of snowboard 12, i.e., so as to reduce angle $\propto$, is prevented by the engagement of pawl 48 on arm 44 with detent 40. Rotation of binding 14 toward the longitudinal axis of snowboard 12, is enabled by deflecting or bending or flexing locking lever 32 in direction B so as to rotate the binding about rotation axis B'. This may be accomplished for example by pushing against or kicking the radially outwardly distal end of lever 32 in direction B, against the inherent return biasing resiliency of the material such as spring steel from which the lever is manufactured. Where a plurality of primary detents 40 are provided radially spaced apart on wall 20, the user may select the desired primary detent so as to select a desired angle for the side-forward stance ride position.

To ease mobility on the board when not riding, for example when on relatively flat terrain, or for example in the vicinity of the chairlift boarding or dismount area, or for use in association with a T-bar lift, and without entirely removing the board from the user's feet, normally only the user's rear foot is removed, that is, extracted from the rear binding. This frees the rear foot of the user to engage, for example by kicking in direction B, the distal end of locking lever 32. Lever 32 is kicked on the side opposite to the intended direction of rotation of binding 14. When kicked, lever 32 is deformed so as to rotate pawl 48 radially outwardly of wall 20, to free latched contact of pawl 48 with detent 40. Using either or both of the initial kicking force and continued foot pressure against lever 32, binding 14 and swivel plate 30 are then further rotated in direction B to the toe forward or forward-walking positions or orientations of FIG. 6 where angle $\propto$ is reduced from the ride position to an acute angle. The available range of motion will depend on the desired range of angular rotation desired for use in the forward walking positions as described better below.

In the forward-walking positions the user's forward foot and ankle in binding 14 is under less angular strain than in the ride position when the rear foot is used to peddle for forward motion. Accordingly, the detent and pawl securing binding 14 in the forward-walking positions need not provide, and it is not desirable that they provide, the same degree of angular retention or resistance to rotation as the corresponding detent and pawl for retention of the binding in the ride position. As illustrated, detents 40*a* are rounded, permitting rotation of binding 14 in a direction opposite to direction B without the need for foot pressure using the rear foot against locking lever 32, that is, permitting rotation of binding 14 towards the ride position solely due to the force exerted by the user in rotating the forward foot so as to either adjust to the desired angle ∝ in the forward-walking position or to return the binding to latch into the board riding position.

Alternative embodiments for partially impeding or resisting the free-floating rotation of swivel plate 30 relative to the board once pawl 48 on locking lever 32 is freed from latched engagement behind detent 40, and for retaining the swivel plate in a desired forward-walking position, are illustrated in FIGS. 7 through 17, FIGS. 23 through 30, and FIGS. 37 through 43.

Figure 7:
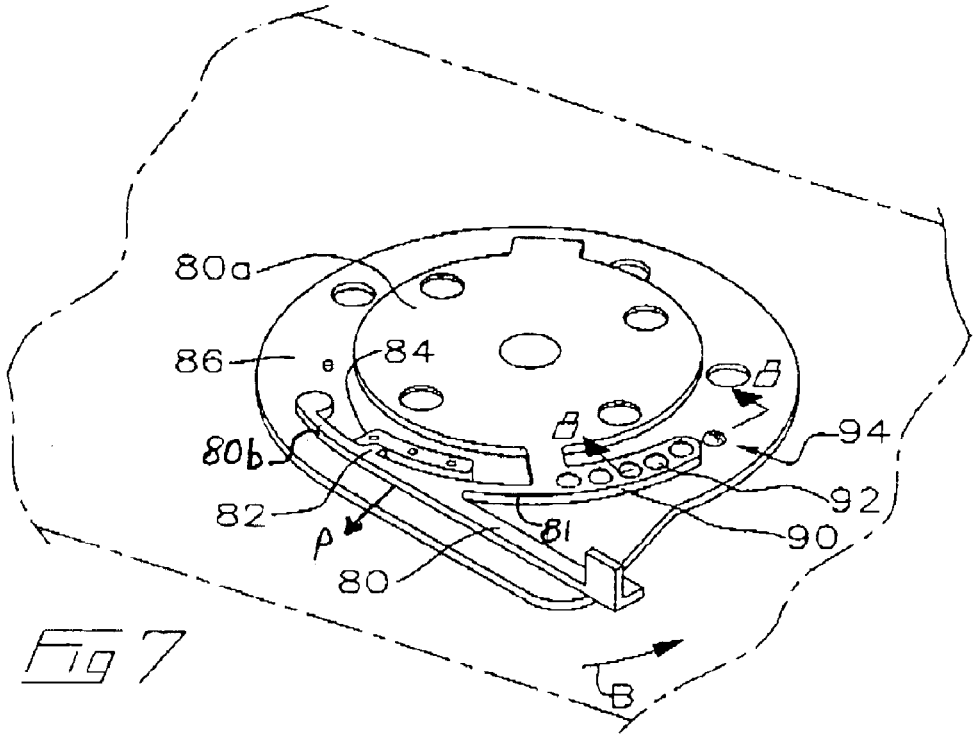
FIG. 7 is an isometric view of an alternative embodiment of the present invention.

As seen in FIG. 7, lever 80, integrally formed with swivel plate 80*a*, has been rotated slightly in direction B by impact from the user's rear foot (not shown). The impact has resulted in a flexure of lever 80 about neck 81, so as to translate pawl 82 and arm 80*b* in direction P resulting in disengaging pawl 82 from detent 84 mounted on lower plate 86. In this position further rotation in direction B, toward the forward-walking positions, is accomplished by a twisting motion in direction B of the user's forward foot (not shown), i.e. the foot held within binding 14 when mounted on swivel plate 80*a*.

Figure 8:
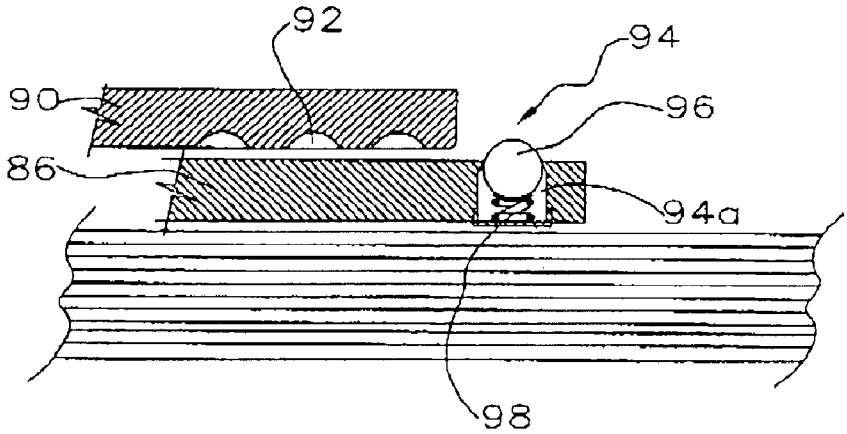
FIG. 8 is a sectional view taken on line 8—8 of FIG. 7.

Arm 90 extends from locking lever 80 in the plane of swivel plate 80*a*. Arm 90 extends arcuately, generally in the direction of rotation B. Arm 90 has formed on its underside an array of recesses 92 (shown in dotted outline) which engage, so as to mate with, a protrusion or pawl 94 projecting from the upper surface of lower plate 86. Protrusion 94 may as seen in FIG. 8 be in the form of a cavity 94*a* containing a sphere, such as a ball bearing, 96. Sphere 96 may be urged by spring 98 so as to project slightly from the open end of cavity 94*a* above the upper surface of lower plate 86. Otherwise protrusion 94 may be a rigid projection or bump relying on the resiliency of arm 90 to allow sliding of the recesses into mating engagement with the projection or bump. As described herein, any protrusion, ball, sphere, bump or rigid projection intended to engage a mating recess or array of recesses, may also be collectively referred to as a pawl.

Engagement of sphere 96 with any one of recesses 92 impedes the free rotation of swivel plate 80*a* as the swivel plate is rotated through the arc defined by the length of the array of recesses 92. This coincides with the desired arc of the forward-walking positions of binding 14. Thus in the forward walking positions, the swivelling of swivel plate 80*a* and hence the orientation of the forward foot may be selected, and actively adjusted by the user to a comfortable toe forward orientation.

Figure 9:
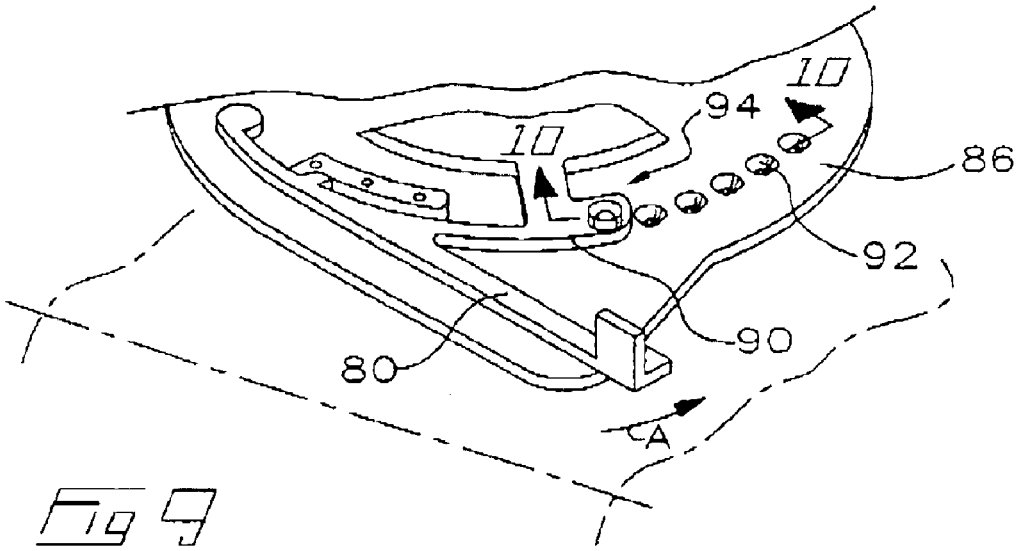
FIG. 9 is an isometric view of an alternative embodiment of the present invention.
Figure 10:
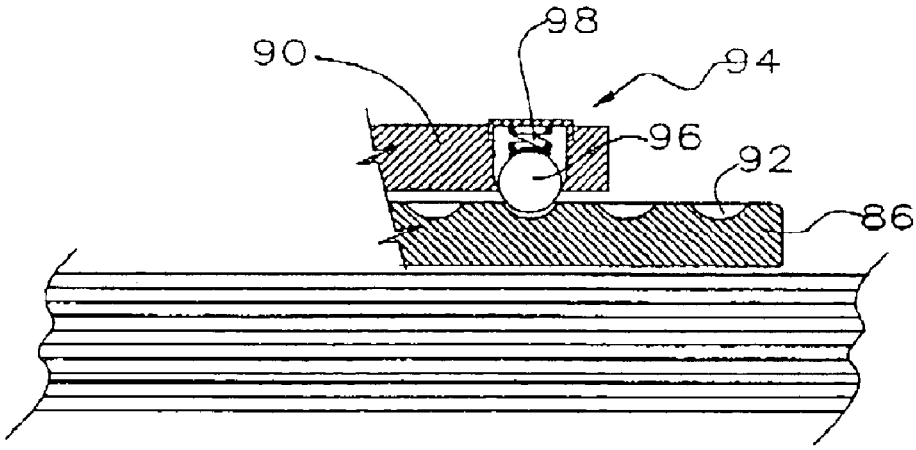
FIG. 10 is a sectional view taken on line 10—10 of FIG. 9.

In FIGS. 9 and 10 the arrangement of recesses 92 and protrusion 94 is reversed. Arm 90 contains protrusion 94. In this embodiment, sphere 96 is urged by spring 98 to project slightly from the underside of arm 90 to resiliently engage recesses 92 formed on the upper surface of lower plate 86.

Figure 11:
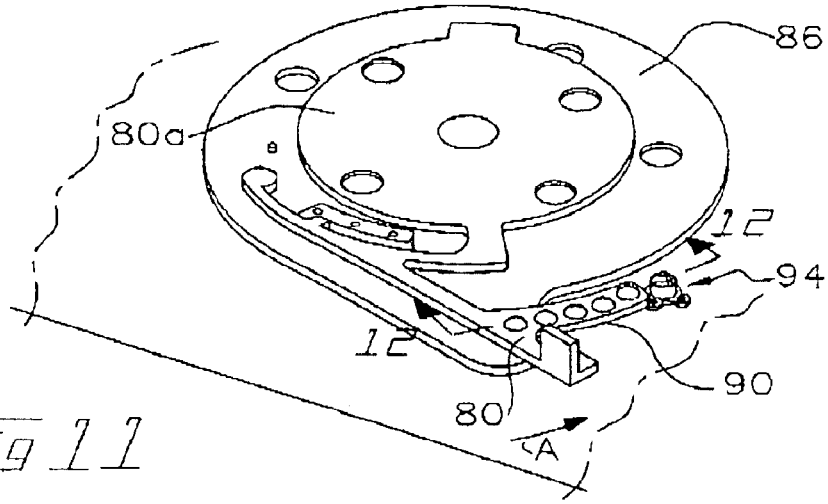
FIG. 11 is an isometric view of an alternative embodiment of the present invention.
Figure 12:
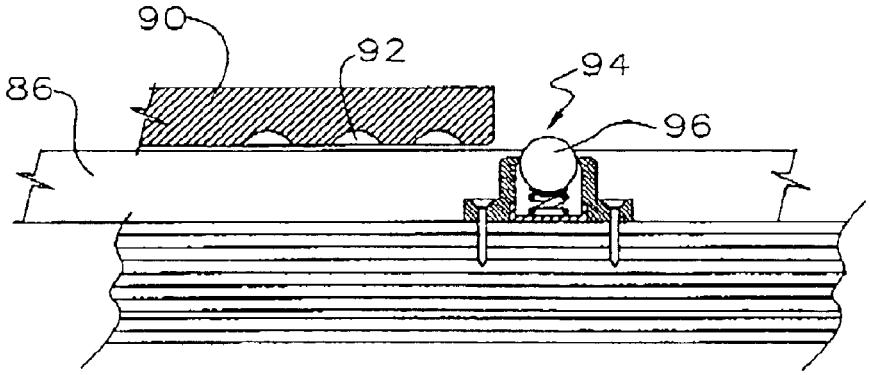
FIG. 12 is a sectional view taken on line 12—12 of FIG. 11.

As seen in the embodiment illustrated in FIGS. 11 and 12, arm 90 extends from locking lever 80 at a radius from the rotation axis B' which exceeds the radius of the outer edge of bottom plate 86. As locking lever 80 and arm 90 are rotated in direction B, protrusion 94 mounted on the upper surface of board 12 will be engaged. Sphere 96 engages recesses 92 on the underside of arm 90 to partially impede or lend resistance to the free-floating rotation of swivel plate 80*a* about axis B'.

Figure 13:
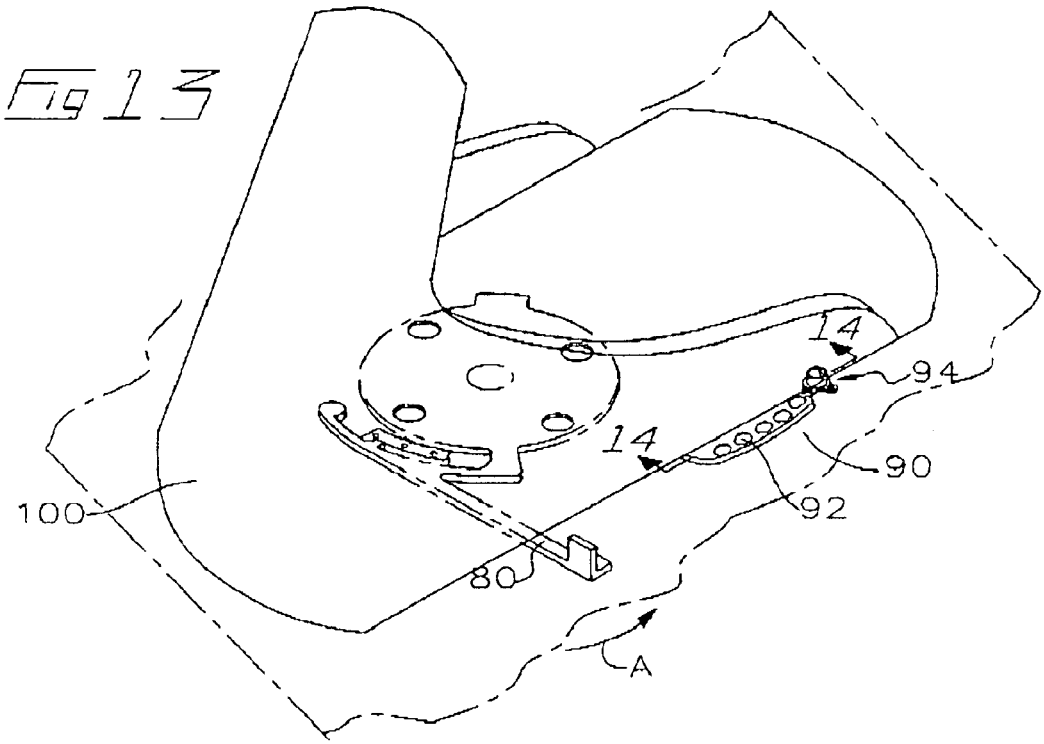
FIG. 13 is an isometric view of an alternative embodiment of the present invention.
Figure 14:
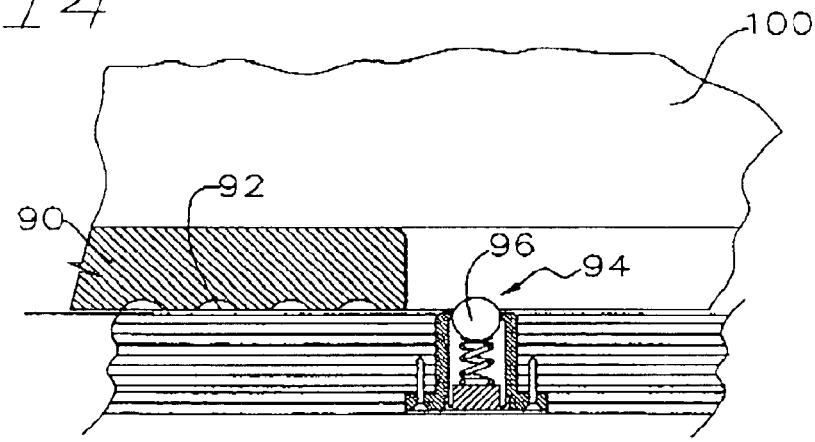
FIG. 14 is a sectional view taken on line 14—14 of FIG. 13.

Illustrated in FIGS. 13 and 14 is an embodiment where arm 90 and locking lever 80 are integrally formed with the sole of binding 100 so as to project radially outwardly therefrom. Arm 90 has an array of recesses 92 formed on its underside. Rotation of the bindings 100, in direction B, brings the circular trajectory of arm 90 into alignment with protrusion 94 projecting from the upper surface of board 12. Frictional engagement of any one of the array of recesses 92 with sphere 96 partially impedes or resists the free-floating rotation of the binding and swivel plate relative to the base plate.

In FIGS. 15 and 16 recess 102 formed adjacent to detent 84 frictionally engages convolutions 104 in opposed facing relation on the end of lever 80 adjacent swivel plate 80*a*. Detent 84 is rigidly mounted to board 12 and pawl 82 must be rotated past recess 102, in direction B, before convolutions 104 are brought into engagement so as to mate in succession with recess 102 as the swivel plate and binding are rotated through the radial are comprising the forward-walking positions.

Figure 17:
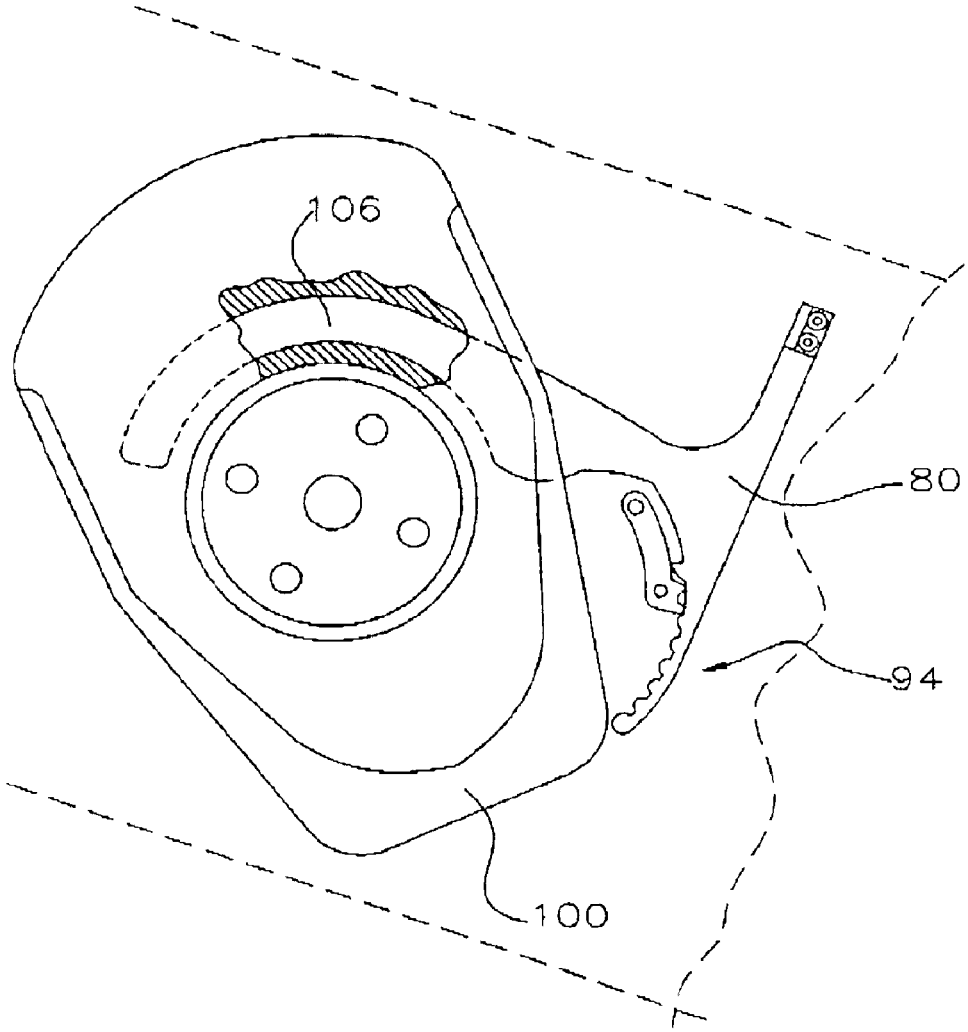
FIG. 17 is a plan view, partially cut-away, illustrating the alternative rotation arresting device of FIG. 15 incorporated into a binding of a snowboard.

FIG. 17 illustrates the device of FIGS. 15 and 16 formed as part of a binding 100. Binding 100 may be molded around a portion of lever 80 such as elongated arm 106. It is expressly intended to be within the scope of the present invention that the swivel plate may be a separate component or an integral component integrally mounted or formed within the forward binding.

FIGS. 18 and 19 illustrate an alternative form of locking detent for lever 80. In this form, detent 84 is formed on a rotatable clip latch 108 mountable either to lower plate 86 or to the upper surface of the board. In the closed position, clip latch 108 clamps or grips a portion, for example the end of lever 80, to retain binding 14 in the ride position. Clip 108 may be resiliently urged by a spring (not shown) to its closed position.

Figure 20:
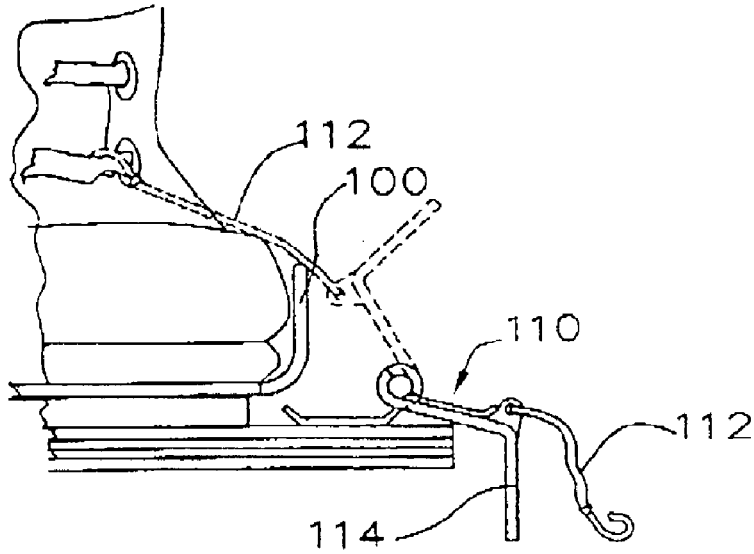
FIG. 20 is a partial front view of a snowboard binding, illustrating one form of spring actuated braking lever.
Figure 21:
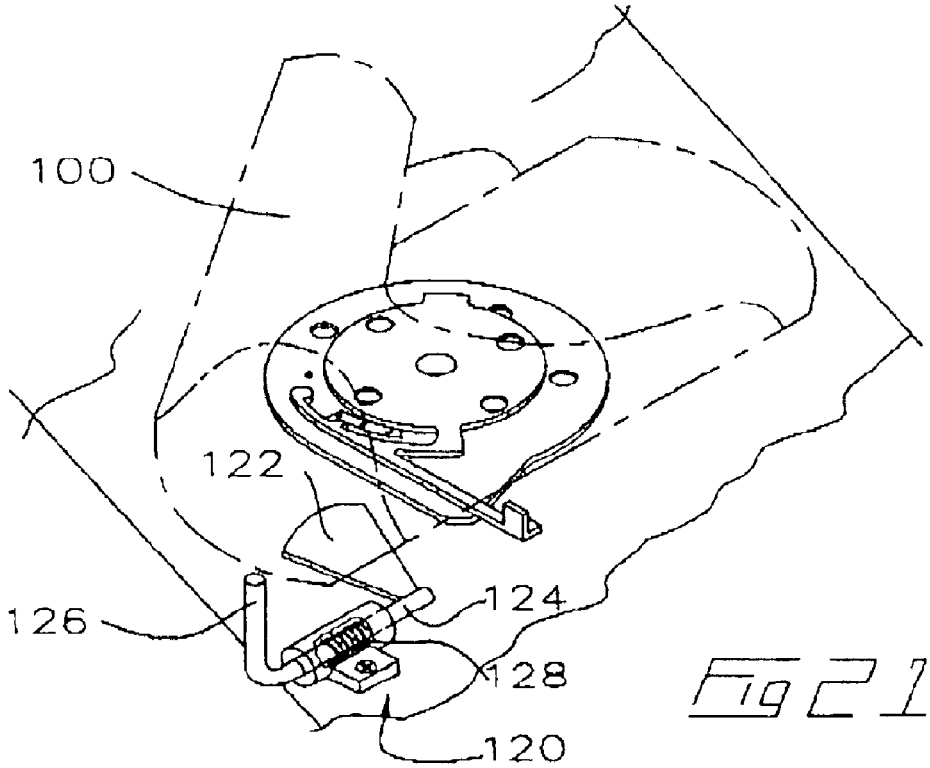
FIG. 21 is an isometric view of an alternative form of spring actuated braking lever.
Figure 22:
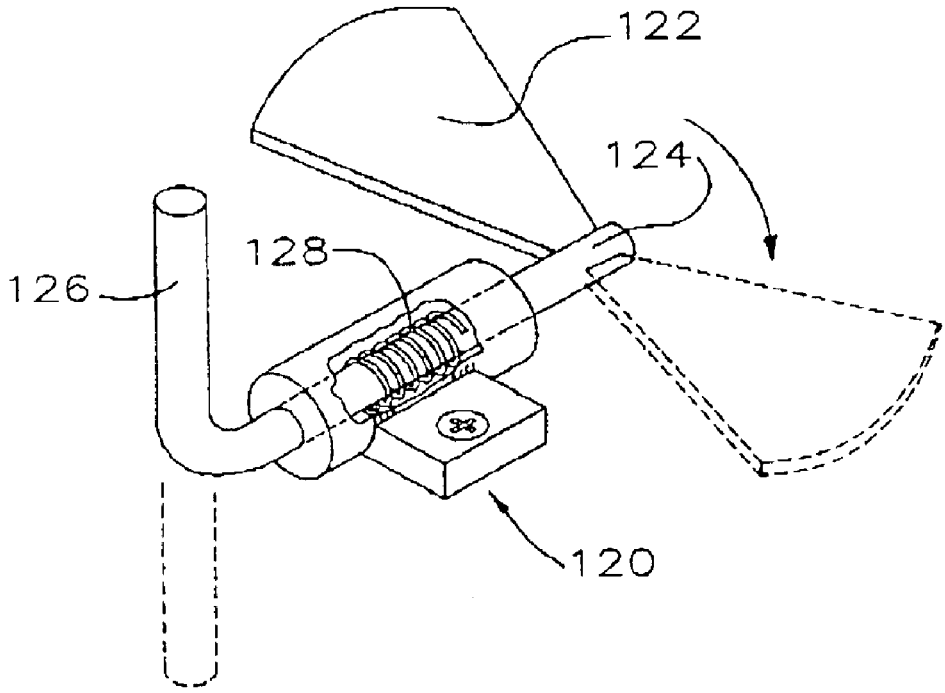
FIG. 22 is an enlarged isometric view of the alternative form of spring actuated braking lever of FIG. 21.

FIGS. 20 through 22 illustrate optional spring operated brake arms intended to prevent dismounted boards from careening downhill. A run-away board on a steep slope may attain a speed which may cause serious injury should the board collide with a person, or damage to the board should it strike a solid object.

FIG. 20 illustrates a brake mechanism 110 which is pivotally mounted to a board adjacent to a binding, for example a binding 100. Brake 110 is held in a retracted position, as shown in broken lines, by securing the free end of a flexible tether 112 to a lace of a boot. Tether 112 may be resilient such as of elastic cord. Upon release of tether 112 from the boot lace, as would be the case when the user steps out of binding 100, spring action pivots brake mechanism 110 to the deployed position illustrated in solid lines. Brake arm 114 is sufficiently long so that, in the deployed position, the downwardly projecting distal end portion of brake arm 114 extends sufficiently below the underside of the board to dig into the surface over which the board is riding to inhibit run-away of the board.

In FIGS. 21 and 22 an alternative spring loaded braking mechanism 120 is shown having a pressure paddle 122 at one end of a rotatable shaft 124 and a brake arm 126 at the opposite end. Paddle 122 is rotated to elevate brake arm 126 so that paddle 122 lies within a heel cut-away portion of the binding. Placement of a foot within the binding maintains brake arm 126 in the elevated position. Removal of the foot from the binding allows 180 degree rotation of paddle 122 and brake arm 126 by action of spring 128 to extend the end portion of arm 126 below the underside of the board to dig into the terrain surface.

Figure 23:
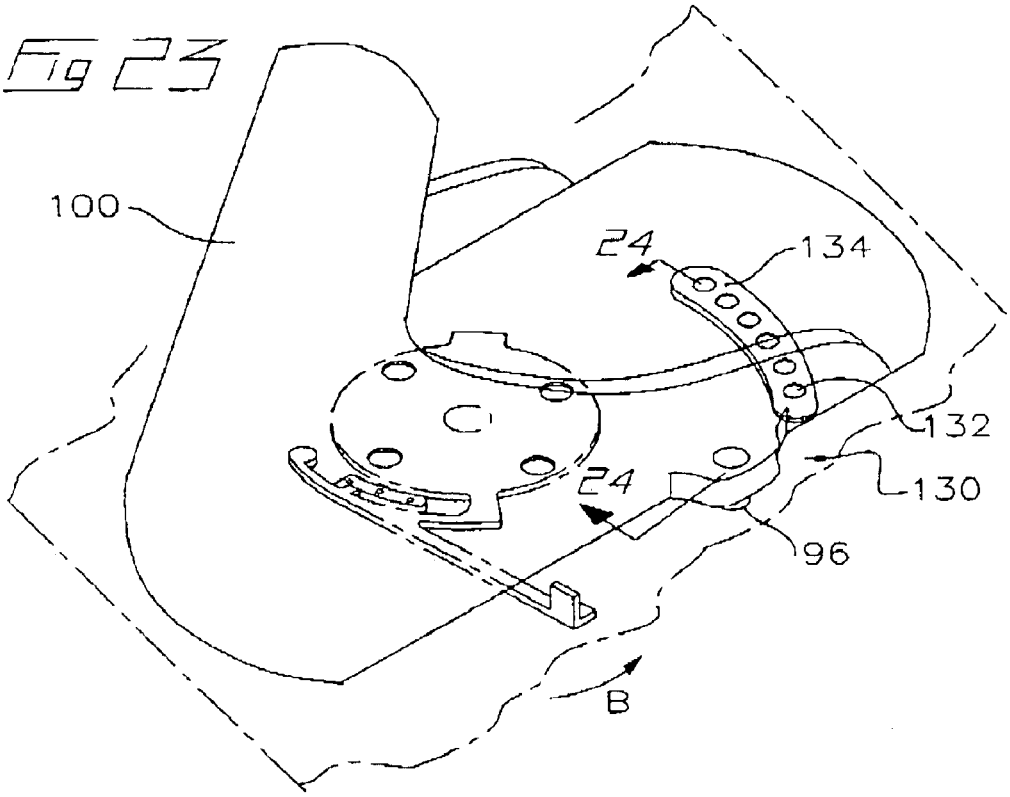
FIG. 23 is an isometric view of an alternative embodiment of the present invention.
Figure 24:
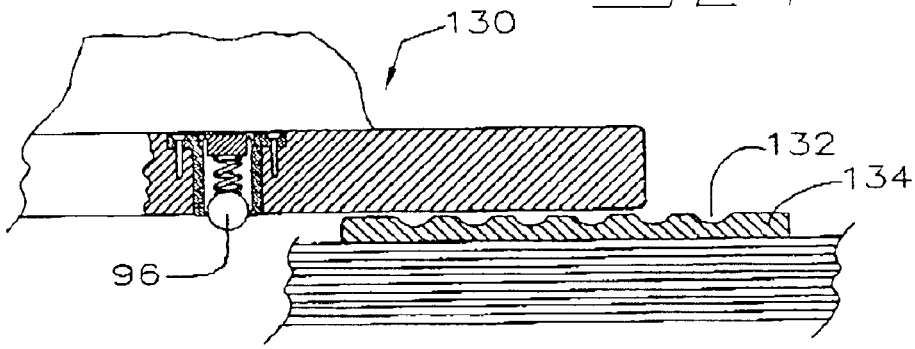
FIG. 24 is a sectional view taken on line 24—24 of FIG. 23.

Illustrated in FIGS. 23 and 24 is an embodiment which incorporates an integrally formed resistance device 130 within the sole of binding 100. Rotation of the binding in direction B brings sphere 96, protruding from resistance device 130, into arcuate alignment with recesses 132 on bar 134. Bar 134 is rigidly mounted on the upper surface of the board. Engagement of any one of the series of recesses 132 with spring-loaded sphere 96 partially impedes the free-floating rotation of the binding without fixedly locking rotation so that manual intervention by hand is needed to adjust the forward-walking position.

Figure 25:
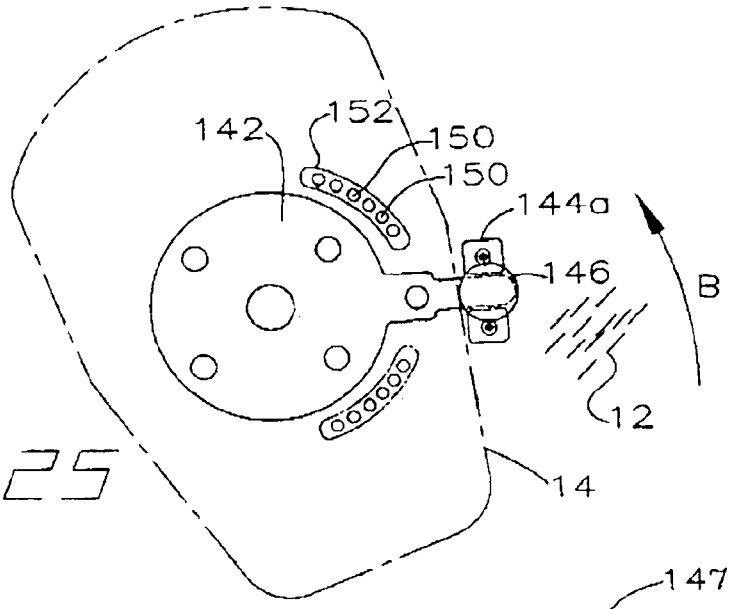
FIG. 25 is, in plan view, a further embodiment of the ride position latching mechanism of the swivel mount of the present invention.
Figure 26:
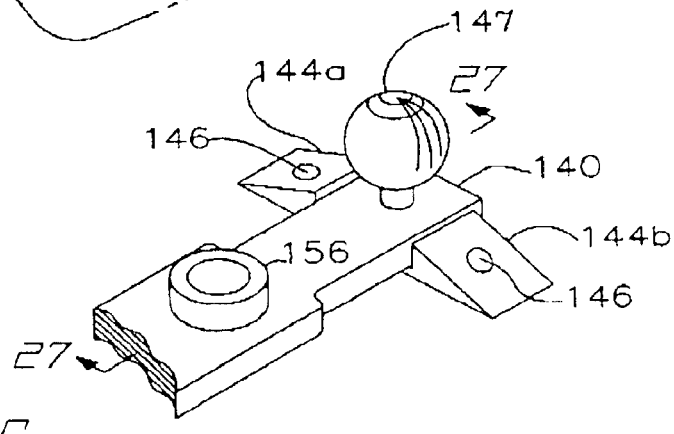
FIG. 26 is, in partially cut-away perspective view, the ride position latch mechanism of FIG. 25.
Figure 27:
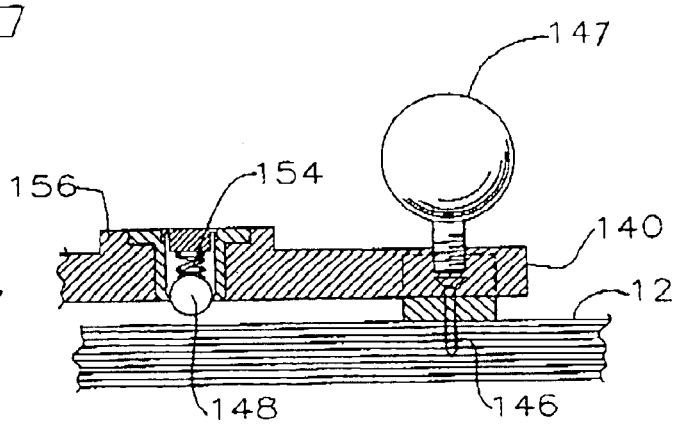
FIG. 27 is a cross-sectional view along line 27—27 in FIG. 26.

FIGS. 25–27 illustrate a further alternative embodiment of the swivel mount ride position latch mechanism. In particular, arm 140 extends resiliently from swivel plate 142 for rotation in direction B so as to rotate binding 14 relative to snowboard 12. Arm 140 is illustrated latched in the ride position the distal end of arm 140 releasably snugly mated between opposed facing wedges 144*a* and 144*b*. Wedges 144*a* and 144*b* are rigidly mounted to board 12 for example by fasteners such as bolts or screws 146. Arm 140 may be unlatched from mating engagement between wedges 144*a* and 144*b* by a user lifting the distal end of arm. 140 against the return resilient biasing force of the arm, so as to lift it above the uppermost edge of 144*a* thereby allowing rotation of arm 140 in direction B over wedge 144*a*. Lifting of arm 140 may be done by a user grasping and pulling upwardly on knob 147. The use of knob 147 is not intended to be limiting and in a further embodiment is replaced by foot actuable device, for example where knob 147 is replaced by a toe cup (shown in dotted outline as a cut-away from the knob) mounted to the distal end of arm 140. In this embodiment the rear foot of the user may be used to engage the toe cup and then simply lift the toe cup with the rear foot so as to disengage arm 140 from wedge 144*a* allowing the rear foot of the user to then urge arm 140 in direction B so as to rotate binding 14 into the forward-walking positions.

In the forward-walking positions, a downward protrusion from arm 140, for example spring loaded ball 148, engages recesses 150 in curved bar 152 mounted to board 12. The resilient mating engagement of the protrusion such as spring loaded ball 148 from the bottom of arm 140 resiliently mates with recesses 150 as binding 14 is rotated in direction B by the rotation of the forward foot of the user and by reason also of any rotational momentum imparted by the rear foot of the user if used to unlatch arm 140 from the ride position.

It is to be understood that whether the downward protrusion from arm 140 is resiliently mated with recesses 150 because of the resilient bending of arm 140 or the resilient compression of spring 154 within housing 156, the end result is that the relative position of binding 14 relative to board 12 may be adjusted by manual rotation of the user's forward foot so that the user may adjust into a comfortable forward-walking position depending on whether the user is forwardly translating by pedalling with the free rear foot, or exiting from a chair lift down an inclined ramp or otherwise in transit where temporarily the terrain is downwardly inclined so that the user may ride on the board, the terrain such that intermittent pedalling is still needed. Thus the user may quickly shift from a comfortable in-line forward-walking position to an angularly offset forward translating position while still remaining within the forward-walking range of positions.

During forward translation, when not pedalling, the rear foot may be placed on the board for example between the forward and rear bindings. Typically a no-slip pad is installed on the board between the bindings expressly for temporary frictional engagement between the board and the rear foot of the user.

Collectively herein, all of the so-called forward-walking positions, including the straight in-line position which is perhaps the most comfortable for forward transit using the rear foot to pedal the board in a forward motion, and what is described herein loosely as within an acute angle from the in-line position, are all encompassed within the generic term forward-walking positions. Consequently a user, once un-latched from the ride position, may enter the range of forward-walking positions immediately radially adjacent the ride position. Thus when exiting a chairlift the user may, for example while on the chairlift, have positioned the forward foot and binding into a position very close to the ride position. This gives the user a familiar ride feel when riding down the off ramp. Once off the ramp, the user may then latch into the ride position for downhill riding.

Figure 29:
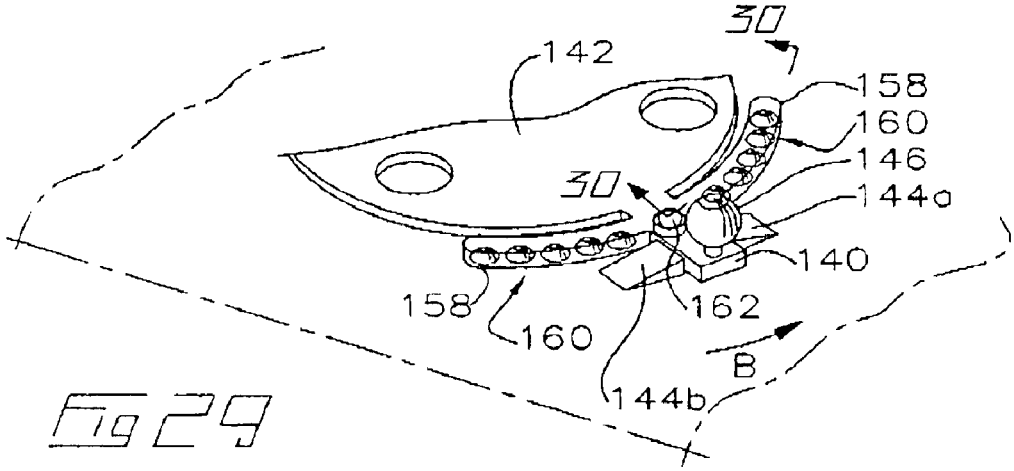
FIG. 29 is, in partially cut-away perspective view, a further alternative embodiment of the forward-walking position resistance mechanism of FIG. 25.
Figure 30:
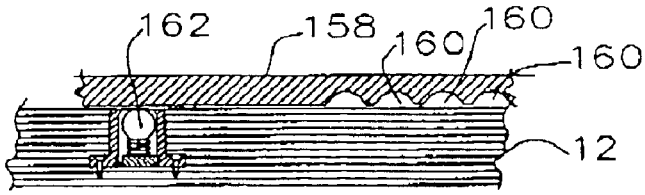
FIG. 30 is a cross-sectional view taken along line 30—30 in FIG. 29.

Thus the latch mechanism for holding binding 14 in the ride position will be located in a radial position relative to the swivel plate so as to not interfere with the resilient engagement of the rotational resistance mechanism engaged in the forward-walking positions. The latch mechanism also should not protrude from the board surface so as not to interfere with use of the board while either riding or translating when the binding is in the forward-walking positions. Consequently, where the ride position latch mechanism is an arm protruding from the swivel plate, generally the arm will be positioned radially spaced from the rotational resistance mechanism in the forward-walking positions. Thus as seen in FIGS. 29 and 30, the forward-walking position resistance mechanism includes curved bars 158 extending from arm 140, each bar 158 having recesses 160 on its under surface so as to engage a protrusion protruding upwardly from board 12 such as spring loaded ball 162.

Figure 28:
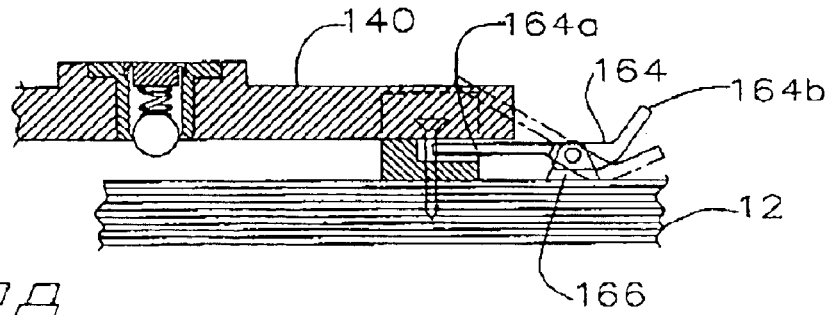
FIG. 28 is a partially cut-away cross-sectional view of an alternative embodiment ride position latch releasing mechanism corresponding to the view of FIG. 27.

As seen in FIG. 28, a foot operated release such as rocker arm 164 may be mounted to board 12 and employed to release arm 140 from between wedges 144*a* and 144*b*. Thus, with cantilevered end 164*a* of rocker arm 164 positioned between the wedges and underneath the distal end of arm 140 when latched in the ride position, the rear foot of the user may be used to press down on upturned end 164*b* about fulcrum mount 166 so as to engage cantilevered end 164*a* with the underside of arm 140. This elevates the distal end of arm 140 above wedge 144*a* allowing for rotation of the binding in direction B from the ride position into the forward-walking positions.

Figure 31:
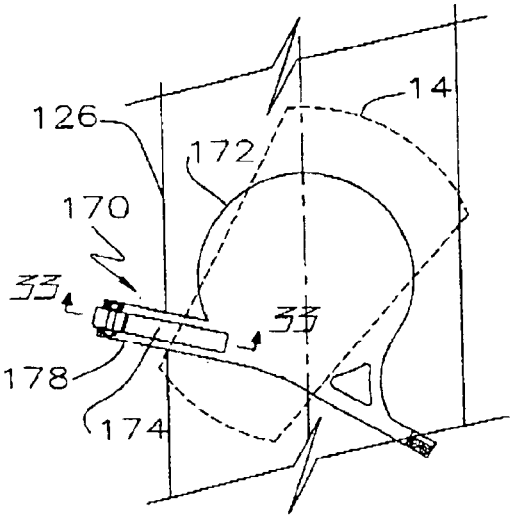
FIG. 31 is, in partially cut away plan view, a board braking mechanism mounted to a swivel plate according to the present invention when rotated into a forward walking position.
Figure 32:
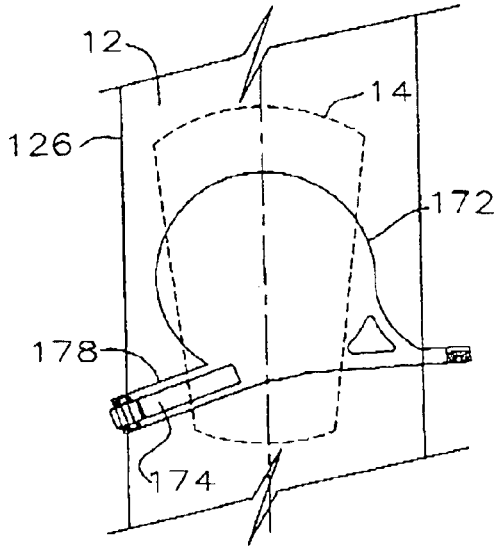
FIG. 32 is the view of FIG. 31 with the swivel plate rotated into the in-line forward-walking position.
Figure 33:
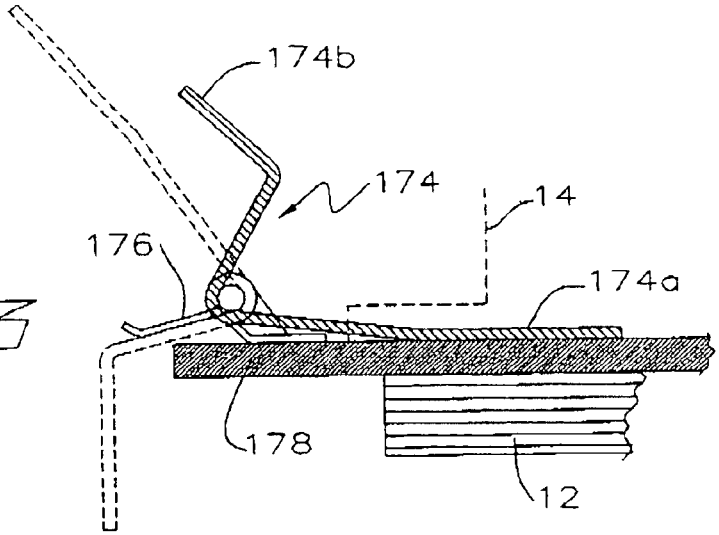
FIG. 33 is a cross-sectional view along line 33—33 in FIG. 31.

FIGS. 31–33 illustrate a board braking mechanism 170 mounted to swivel plate 172. The brake mechanism has a resiliently urged arm 174 pivotally mounted for example for pivotal movement about spring 176 relative to base member 178 on swivel plate 172. Within the range of typical ride positions such as illustrated in FIGS. 31 and 32, base member 178 extends from beneath binding 14 so as to dispose arm 174 for deployment over the left hand edge 12*b* of snowboard 12.

Arm 174 may, without intending to be limiting, be bent into a Z-shape so that when foot pressure of a user's forward foot in binding 14 is removed from pressing down on end 174*a* of arm 174, spring 176 then resiliently urges the opposite end 174*b* away from binding 14 into a downwardly disposed position engaging the terrain beneath board 12.

Figure 34:
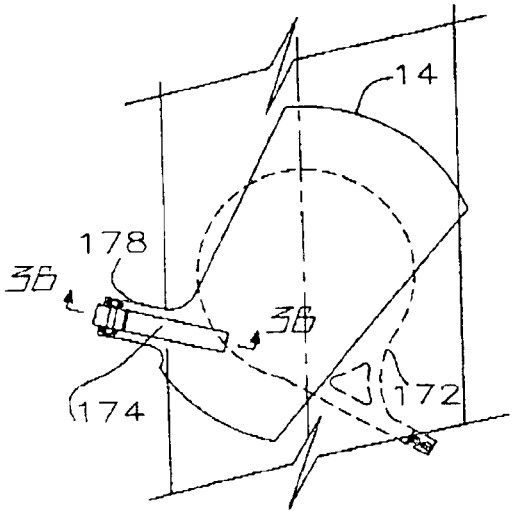
FIGS. 34–36 correspond to FIGS. 31–33 in an embodiment where the braking mechanism is mounted to the binding.
Figure 35:
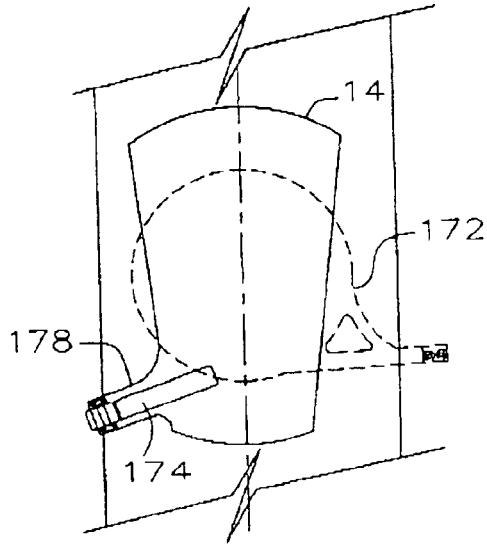
Figure 36:
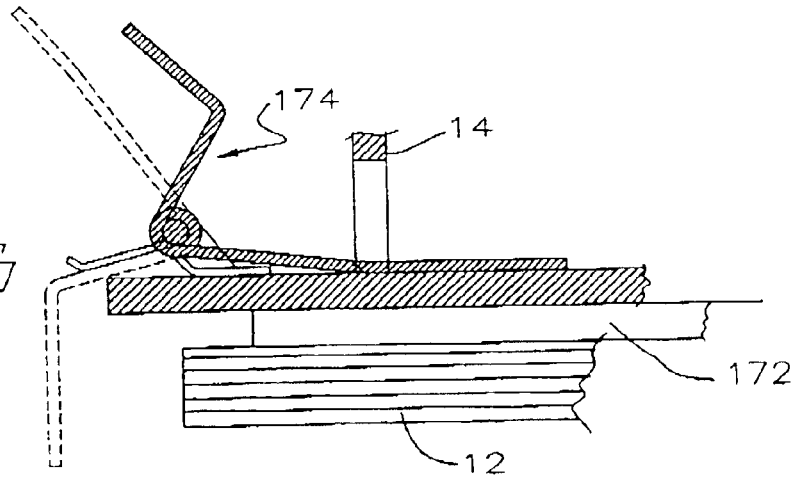

In FIGS. 34–36, arm 174 operates in a similar fashion to the embodiment of FIGS. 31–33, but is however mounted directly to binding 14 instead of mounted to swivel plate 172.

In the embodiment of FIGS. 37 and 38, arm 140 on swivel plate 172 is latched in the ride position within slide housing 180. The cavity within slide housing 180 captures the distal end of arm 140 when slide housing 180 is slid radially inwardly relative to swivel plate 172 along linear track 182 formed within rigid member 184 extending from base 18. In the embodiment illustrated, the forward-walking position resistance mechanism includes upwardly protruding pawls such as bumps or protrusions 186 in a curved array so as to engage a corresponding recess 188 formed on the underside of arm 140 as arm 140 is rotated in direction B from the ride position into the forward-walking positions. As before, it is not intended to be limiting that the pawl protrusions are mounted on the base plate and the recess on the swivel plate, as it is intended to be within the scope of the present invention that the recesses may be formed in the base plate and the pawl protrusion for mating with the recesses be formed on the swivel plate.

Figure 39:
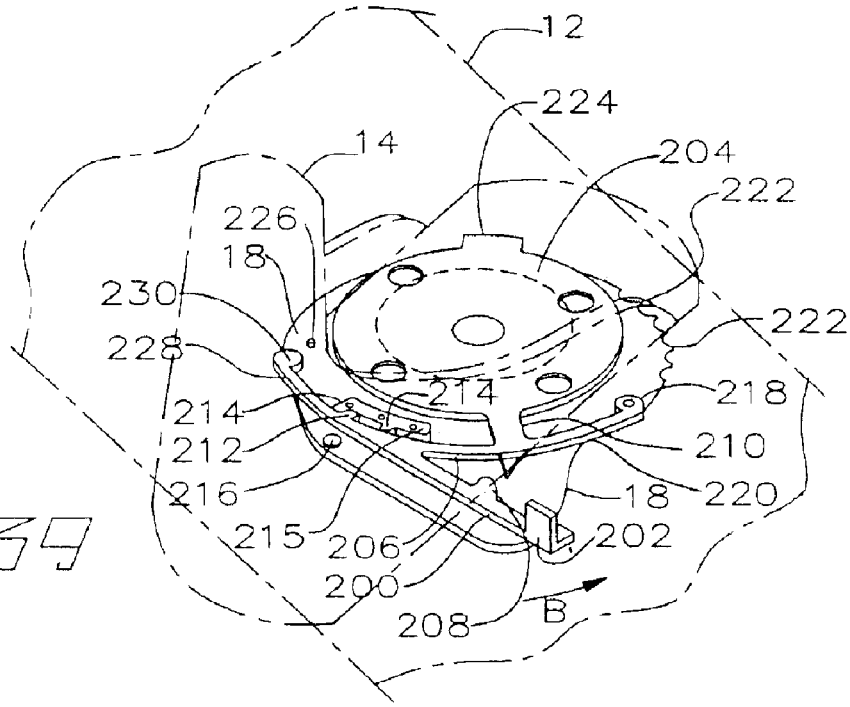
FIG. 39 is, in partially cut-away perspective view, a further alternative embodiment of the present invention in the ride position.
Figure 40:
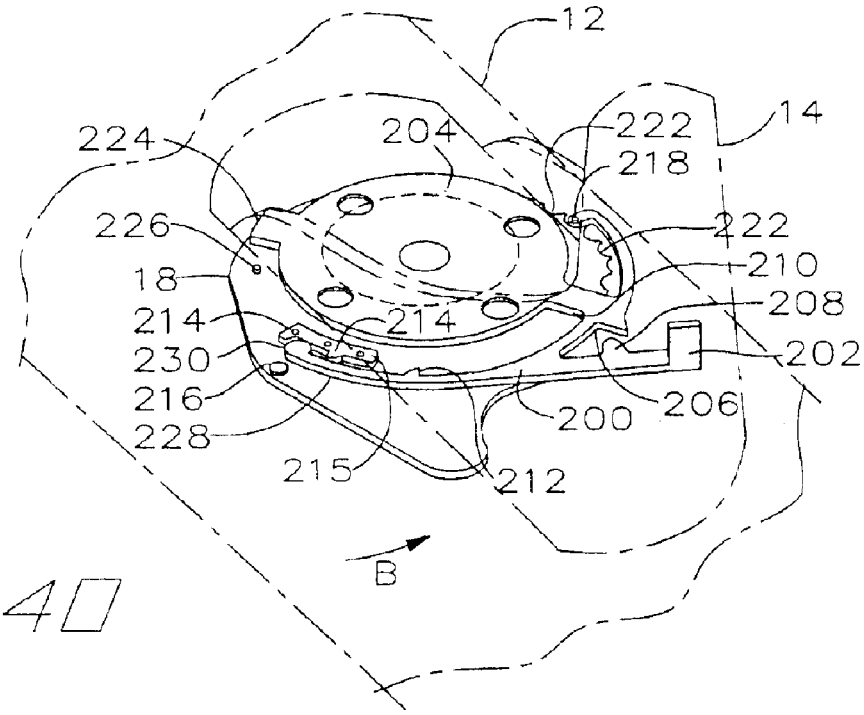
FIG. 40 is the swivel mount of FIG. 39 in a forward-walking position.

As seen in FIGS. 39 and 40, kick arm 200 has rigidly mounted at its distal end a kick plate 202. The radially inward end of kick arm 200 is mounted to swivel plate 204 by resilient flex arm 206. The amount of flexing of flex arm 206 when kick plate 202 is kicked by a user's rear foot is limited by stop arm 208 engaging the base arm 210 extending from the swivel plate.

Ride position latch pawl 212 protrudes radially inwardly from the inner end of kick arm 200 so as to engage one of the ride position detents 214 on the detent member 215 mounted to base plate 18. The user selects which detent 214 to use, for example which is most comfortable or best suited to the desired board riding.

When kick arm 200 has been rotated in direction B from the ride position to the forward-walking position, pawl 218 mounted on the end of flex arm 220 engages a radially spaced array of recesses, convolutions, corrugations or teeth 222 radially spaced around base 18.

Flange 224 extends rigidly from swivel plate 204 so as to engage stop 226 as binding 14 on swivel plate 204 is rotated into the in-line forward-walking position.

A secondary flex arm 228 may be provided which extends from the radially innermost end of kick arm 200. Secondary pawl 230 is mounted at the distal end of secondary flex arm 228 so as to engage a protrusion mounted to base plate 18 or board 12 such as detent 214. Secondary pawl 230 is radially spaced on secondary flex arm 228 so that, as kick arm 200 is rotating in direction B, secondary pawl 230 disengages from detent 214 once pawl 218 is in engagement with teeth 222, that is, begins rotating through the forward-walking positions. Secondary pawl 230 thus provides tactile feedback to the user indicating for example the mid-range or the end of range of motion in the forward-walking positions. Over-rotation of secondary flex arm 228 is prevented by stop 216. Pawl 230 may further provide a resiliently biased increase in rotational resistance as swivel plate is rotated in a direction opposite to direction B to indicate to the user that the binding has been rotated to, for example, the mid-range or the limit of travel within the forward-walking positions. If the user then desires to continue rotation of the binding so as to return to the ride position, the slightly increased rotational resistance provided by secondary pawl riding over detent 214 is overcome by the user deliberately twisting the forward foot.

In the embodiment of FIGS. 41–43, arm 140 on swivel plate 142 in the ride position is again mated behind wedge 144*a*. In this embodiment however, instead of the use of a knob 146 or toe cup, or the use of a rocker arm to release the distal end of arm 140 from being latched in the ride position behind wedge 144*a*, a rocker arm 190 is mounted to arm 140 for example by means of hinge 192 so as to extend over wedge 144*a* for rotation about axis C. Rocker arm 190 may be resiliently urged down onto wedges 144*a* by a spring (not shown). Rocker arm 190 has at its opposite end to hinge 192 an upturned toe catch 194 so that a force applied downwardly on toe catch 194 rotates rocker arm 190 about axis D, being the pivot point of fulcrum 196 resting on wedge 144*a*. Rotation of rocker arm 190 about fulcrum 196 elevates arm 140 above wedge 144*a* so as to release arm 140 from latched engagement in the ride position behind wedge 144*a*.

Thus for a user to unlatch binding 14 from the ride position, the toe of the user's rear foot may be used to engage toe catch 194 so as to both rotate rocker arm 190 about fulcrum 196 and, once arm 140 is released from behind wedge 144*a*, to slide rocker arm 190 and thus arm 140 in direction B thereby assisting the rotation of binding 14 into the forward-walking positions. The pressing down onto toe catch 194 may be a discrete first movement by the user's rear foot then followed by a sliding of the rocker arm in direction B, or the movement by the user's rear foot may be a combined pressing down and sliding, for example so as to direct a force applied by the user's rear foot in direction A' to simultaneously rotate rocker arm 190 freeing arm 140 and rotating arm 140 in direction B by reason of the force vector component in direction A.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A swivel mount for a board binding comprising:

a base mountable to an upper surface of a board, a swivel plate mounted on said base for relative swivelling rotation of said swivel plate relative to said base between a ride position and forward-walking positions, wherein when said binding is mounted on said swivel plate and said swivel plate is in said ride position said binding is oriented generally perpendicularly to a longitudinal axis of said board, and wherein when said binding is mounted on said swivel plate and said swivel plate is in said forward-walking positions, said forward-walking positions extending in a radial arc radially spaced from said ride position, said binding is oriented to point a user's first foot in said binding toward a front end of said board so as to generally form an acute angle between said binding and said longitudinal axis of said board, a non-locking, non free-floating rotational resistance means cooperating between said swivel plate and said base for increasing rotational resistance above that of free-floating rotation but without locking of said swivel plate in a preset locking position when swivelling said swivel plate through said radial arc, said rotational resistance means providing resistance of a level between free-floating rotation having substantially no resistance to rotation, and locking rotational resistance requiring unlocking by a user's hand or second foot to permit rotation, at least one ride position latch for releasably locking said swivel plate in said ride position relative to said base upon rotational urging by said user's first foot when said first foot is in said binding and said binding mounted to said swivel plate so as to return said swivel plate from said forward-walking positions to said ride position, an actuator for releasing said ride position latch, wherein said actuator is actuated by a force applied by said second foot in a first direction urging said swivel plate to swivel from said ride position to said forward-walking positions, wherein said actuator comprises a flexible arm flexibly mounted to said swivel plate, said flexible arm having a force receiving member at a first distal end thereof, said first distal end extending generally radially outwardly of said swivel plate.

2. The swivel mount of claim 1 wherein said ride position latch comprises a first pawl mounted on said flexible arm and a detent member fixedly mounted relative to said upper surface of said board, said detent member forming a detent, said first pawl for releasably engaging said detent so as to releasably lock said swivel plate in said ride position, said flexible arm actuable by a force applied generally in said first direction so as to flex relative to said swivel plate to thereby release said pawl from said engagement with said detent.

3. The swivel mount of claim 2 wherein said resistance means comprises a second pawl and an array of pawl receivers lying in a rotational trajectory of said second pawl for mating with said second pawl.

4. The swivel mount of claim 3 wherein said second pawl is mounted on said swivel plate, and said array of pawl receivers is formed in said base.

5. The swivel mount of claim 3 wherein said second pawl is mounted on said flexible arm and said array of pawl receivers is formed on said base.

6. The swivel mount of claim 2 wherein said detent member is mounted to said base.

7. The swivel mount of claim 1 wherein said ride position latch comprises a detent member fixedly mounted relative to said upper surface of said board, said detent member forming a detent, said flexible arm releasably engaging said detent so as to releasably lock said swivel plate in said ride position.

8. The swivel mount of claim 7 wherein said resistance means comprises a second pawl and an array of pawl receivers lying in a rotational trajectory of said second pawl for mating with said second pawl.

9. The swivel mount of claim 8 wherein said second pawl is mounted on said swivel plate, and said array of pawl receivers is formed in said base.

10. The swivel mount of claim 8 wherein said second pawl is mounted on said flexible arm and said array of pawl receivers is formed on said base.

11. The swivel mount of claim 7 wherein said detent member is mounted to said base.

12. The swivel mount of claim 7 wherein said force receiving member, upon receiving a force applied thereto, flexes said flexible arm so as to disengage said flexible arm from said detent.

13. The swivel mount of claim 12 wherein said resistance means comprises a second pawl and an array of pawl receivers lying in a rotational trajectory of said second pawl for mating with said second pawl.

14. The swivel mount of claim 13 wherein said second pawl is mounted on said swivel plate, and said array of pawl receivers is formed in said base.

15. The swivel mount of claim 13 wherein said second pawl is mounted on said flexible arm and said array of pawl receivers is formed on said base.

16. The swivel mount of claim 12 wherein said detent member is mounted to said base.

17. The swivel mount of claim 1 wherein said resistance means comprises a second pawl and an array of pawl receivers lying in a rotational trajectory of said second pawl for mating with said second pawl.

18. The swivel mount of claim 1 wherein said resistance means comprises a second pawl and an array of pawl receivers lying in a rotational trajectory of said second pawl for mating with said second pawl.

19. The swivel mount of claim 18 wherein said second pawl is mounted on said swivel plate, and said array of pawl receivers is formed in said base.

20. The swivel mount of claim 18 wherein said second pawl is mounted on said flexible arm and said array of pawl receivers is formed on said base.

21. The swivel mount of claim 1 wherein said second pawl is mounted on said swivel plate, and said array of pawl receivers is formed in said base.

22. A swivel mount for a board binding comprising:

a base mountable to an upper surface of a board, a swivel plate mounted to said binding and rotatably mounted on said base for relative swivelling rotation of said swivel plate relative to said base between a ride position and forward-walking positions, wherein when said swivel plate is in said ride position, said binding is oriented generally perpendicularly to a longitudinal axis of said board, and wherein when said swivel plate is in said forward-walking positions, said forward-walking positions extending in a radial arc radially spaced from said ride position, said binding is oriented to point a user's first foot in said binding toward a front end of said board so as to generally form an acute angle between said binding and said longitudinal axis of said board, a non-locking, non free-floating rotational resistance means cooperating between said swivel plate and said base for increasing rotational resistance above that of free-floating rotation but without locking of said swivel plate in a preset locking position when swivelling said swivel plate through said radial arc, said rotational resistance means providing resistance of a level between free-floating rotation having substantially no resistance to rotation, and locking rotational resistance requiring unlocking by a user's hand or second foot to permit rotation, at least one ride position latch for releasably locking said swivel plate in said ride position relative to said base upon rotational urging by said user's first foot when said first foot is in said binding so as to return said swivel plate from said forward-walking positions to said ride position, an actuator for releasing said ride position latch, wherein said actuator is actuated by a force applied by said second foot in a first direction urging said swivel plate to swivel from said ride position to said forward-walking positions, wherein said actuator comprises a flexible arm flexibly mounted to said swivel plate, said flexible arm having a force receiving member at a first distal end thereof, said first distal end extending generally radially outwardly of said swivel plate.

23. The swivel mount of claim 22 wherein said ride position latch comprises a first pawl mounted on said flexible arm and a detent member fixedly mounted relative to said upper surface of said board, said detent member forming a detent, said first pawl for releasably engaging said detent so as to releasably lock said swivel plate in said ride position, said flexible arm actuable by a force applied generally in said first direction so as to flex relative to said swivel plate to thereby release said pawl from said engagement with said detent.

24. The swivel mount of claim 23 wherein said resistance means comprises a second pawl and an array of pawl receivers lying in a rotational trajectory of said second pawl for mating with said second pawl.

25. The swivel mount of claim 24 wherein said second pawl is mounted on said swivel plate, and said array of pawl receivers is formed in said base.

26. The swivel mount of claim 24 wherein said second pawl is mounted on said flexible arm and said array of pawl receivers is formed on said base.

27. The swivel mount of claim 23 wherein said detent member is mounted to said base.

28. The swivel mount of claim 22 wherein said ride position latch comprises a detent member fixedly mounted relative to said upper surface of said board, said detent member forming a detent, said flexible arm releasably engaging said detent so as to releasably lock said swivel plate in said ride position.

29. The swivel mount of claim 28 wherein said resistance means comprises a second pawl and an array of pawl receivers lying in a rotational trajectory of said second pawl for mating with said second pawl.

30. The swivel mount of claim 29 wherein said second pawl is mounted on said swivel plate, and said array of pawl receivers is formed in said base.

31. The swivel mount of claim 29 wherein said second pawl is mounted on said flexible arm and said array of pawl receivers is formed on said base.

32. The swivel mount of claim 28 wherein said force receiving member, upon receiving a force applied thereto, flexes said flexible arm so as to disengage said flexible arm from said detent.

33. The swivel mount of claim 32 wherein said resistance means comprises a second pawl and an array of pawl receivers lying in a rotational trajectory of said second pawl for mating with said second pawl.

34. The swivel mount of claim 33 wherein said second pawl is mounted on said swivel plate, and said array of pawl receivers is formed in said base.

35. The swivel mount of claim 33 wherein said second pawl is mounted on said flexible arm and said array of pawl receivers is formed on said base.

36. The swivel mount of claim 32 wherein said detent member is mounted to said base.

37. The swivel mount of claim 28 wherein said detent member is mounted to said base.

38. The swivel mount of claim 22 wherein said resistance means comprises a second pawl and an array of pawl receivers lying in a rotational trajectory of said second pawl for mating with said second pawl.

39. The swivel mount of claim 22 wherein said resistance means comprises a second pawl and an array of pawl receivers lying in a rotational trajectory of said second pawl for mating with said second pawl.

40. The swivel mount of claim 39 wherein said second pawl is mounted on said swivel plate, and said array of pawl receivers is formed in said base.

41. The swivel mount of claim 39 wherein said second pawl is mounted on said flexible arm and said array of pawl receivers is formed on said base.

42. The swivel mount of claim 22 wherein said second pawl is mounted on said swivel plate, and said array of pawl receivers is formed in said base.

* * * * *